US011168437B2

(12) United States Patent
Choi et al.

(10) Patent No.: US 11,168,437 B2
(45) Date of Patent: Nov. 9, 2021

(54) DRYER AND CONTROL METHOD THEREOF

(71) Applicant: SAMSUNG ELECTRONICS CO., LTD., Suwon-si (KR)

(72) Inventors: Jin Young Choi, Seongnam-si (KR); Da Eun Kim, Seoul (KR); Sun Soo Kim, Suwon-si (KR); Dong Woo Lee, Yongin-si (KR); Seung Eun Chung, Yongin-si (KR); Jin Han Kim, Suwon-si (KR); Hyun Soo Park, Seoul (KR); Sung Chan Yun, Suwon-si (KR); Seok-Mo Chang, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 97 days.

(21) Appl. No.: 16/657,083

(22) Filed: Oct. 18, 2019

(65) Prior Publication Data

US 2020/0048822 A1 Feb. 13, 2020

Related U.S. Application Data

(63) Continuation of application No. 15/147,091, filed on May 5, 2016, now Pat. No. 10,450,693.
(Continued)

(30) Foreign Application Priority Data

Apr. 28, 2016 (KR) ..... 10-2016-0051905

(51) Int. Cl.
*F26B 13/10* (2006.01)
*D06F 58/12* (2006.01)
(Continued)

(52) U.S. Cl.
CPC ..... *D06F 58/12* (2013.01); *D06F 58/38* (2020.02); *D06F 34/32* (2020.02);
(Continued)

(58) Field of Classification Search
CPC ..... D06F 58/30; D06F 58/12; D06F 58/38; D06F 2103/00; D06F 2103/02;
(Continued)

(56) References Cited

U.S. PATENT DOCUMENTS

2011/0252835 A1 10/2011 Beihoff
2011/0308101 A1 12/2011 Wisherd
(Continued)

FOREIGN PATENT DOCUMENTS

CN 101153456 4/2008
CN 102653911 9/2012
(Continued)

OTHER PUBLICATIONS

Chinese Office Action dated Oct. 11, 2019 in Chinese Patent Application No. 201680019312.4.
(Continued)

*Primary Examiner* — John P McCormack
(74) *Attorney, Agent, or Firm* — Staas & Halsey, LLP

(57) ABSTRACT

A dryer includes a main body, a drying chamber provided inside the main body and configured to accommodate objects to be dried, a conveying unit configured to convey the objects to be dried, a sensor unit configured to sense information on states of the objects to be dried, and a control unit configured to control the conveying unit to move the objects to be dried based on the information sensed by the sensor unit.

7 Claims, 32 Drawing Sheets

Related U.S. Application Data

(60) Provisional application No. 62/158,800, filed on May 8, 2015.

(51) Int. Cl.

| | |
|---|---|
| ***D06F 58/38*** | (2020.01) |
| *D06F 103/02* | (2020.01) |
| *D06F 103/10* | (2020.01) |
| *D06F 103/12* | (2020.01) |
| *D06F 103/34* | (2020.01) |
| *D06F 103/44* | (2020.01) |
| *D06F 105/46* | (2020.01) |
| *D06F 105/52* | (2020.01) |
| *D06F 34/32* | (2020.01) |

(52) U.S. Cl.
CPC ..... *D06F 2103/02* (2020.02); *D06F 2103/10* (2020.02); *D06F 2103/12* (2020.02); *D06F 2103/34* (2020.02); *D06F 2103/44* (2020.02); *D06F 2105/46* (2020.02); *D06F 2105/52* (2020.02)

(58) Field of Classification Search
CPC ..... D06F 2103/10; D06F 2103/12; D06F 2103/34; D06F 2103/44; D06F 2105/46; D06F 2105/52; D06F 34/32
USPC ..... 34/524, 108
See application file for complete search history.

(56) References Cited

U.S. PATENT DOCUMENTS

| | | | | |
|---|---|---|---|---|
| 2014/0325865 | A1* | 11/2014 | Wisherd | D06F 58/266 34/255 |
| 2015/0089829 | A1 | 4/2015 | Herman et al. | |
| 2015/0101207 | A1 | 4/2015 | Herman | |

FOREIGN PATENT DOCUMENTS

| | | |
|---|---|---|
| EP | 2844033 | 3/2015 |
| JP | 9-82468 | 3/1997 |
| JP | 2002-000997 | 1/2002 |
| JP | 2002-136798 | 5/2002 |
| JP | 2009-250474 | 10/2009 |
| KR | 10-0499525 | 7/2005 |
| KR | 10-1052778 | 8/2011 |
| KR | 10-2011-0099919 | 9/2011 |
| KR | 10-1343439 | 12/2013 |
| WO | 2009/102157 | 8/2009 |
| WO | 2013/065925 | 5/2013 |

OTHER PUBLICATIONS

International Search Report dated Aug. 4, 2016 in International Patent Application No. PCT/KR2016/004808.
Extended European Search Report dated Apr. 16, 2018 in European Patent Application No. 16792931.4.
European Office Action dated Feb. 7, 2019 in European Patent Application No. 16792931.4.
U.S. Notice of Allowance dated Jun. 5, 2019 in U.S. Appl. No. 15/147,091.
U.S. Office Action dated Nov. 23, 2018 in U.S. Appl. No. 15/147,091.
U.S. Office Action dated Jun. 1, 2018 in U.S. Appl. No. 15/147,091.
U.S. Appl. No. 15/147,091, filed May 5, 2016, Jin Young Choi, et al., Samsung Electronics Co., Ltd.

* cited by examiner

DRYER AND CONTROL METHOD THEREOF

CROSS-REFERENCE TO RELATED APPLICATIONS

This application is a Continuation Application of U.S. patent application Ser. No. 15/147,091, filed on May 5, 2016, which claims the benefit of U.S. Provisional Application No. 62/158,800, filed on May 8, 2015, and Korean Patent Application No. 10-2016-0051905, filed on Apr. 28, 2016 in the Korean Intellectual Property Office, the disclosures of which are incorporated herein by reference.

BACKGROUND

1. Field

The present disclosure relates to a dryer which dries objects to be dried and a control method thereof.

2. Description of the Related Art

In general, a clothes dryer may dry laundry by adopting a hot air drying method or a drying method using electromagnetic waves such as a microwave.

In a case of a clothes dryer which adopts the hot air drying method, since moisture is dried by air heated using an indirect heating method, efficiency is low and a drying time may be extended.

In a case of a clothes dryer which adopts the microwave method, a thermal runaway phenomenon occurs due to a resonance phenomenon of electromagnetic wave energy and non-uniform heating of clothes may be caused.

SUMMARY

It is an aspect of the present disclosure to provide a dryer in which an electrode disposed at an electrode unit is movable according to states of objects to be dried and a control method thereof.

According to an embodiment, it is an aspect of the present disclosure to provide a dryer in which, when a plurality of objects to be dried are accommodated, positions of the objects to be dried as well as that of an electrode are controlled together according to states of the objects to be dried, and a control method thereof.

According to an embodiment, it is an aspect of the present disclosure to provide a dryer in which a drying space formed inside a drying chamber of the dryer is divided into a plurality of drying spaces by an electrode unit and the size of the divided drying spaces is adjustable, and a control method thereof.

A dryer according to an aspect includes a main body, a drying chamber provided inside the main body and configured to accommodate objects to be dried, a conveying unit configured to convey the objects to be dried, a sensor unit configured to sense information on states of the objects to be dried, and a control unit configured to control the conveying unit to move the objects to be dried based on the information sensed by the sensor unit.

According to an embodiment, the control unit may control the conveying unit to adjust intervals between the objects to be dried.

According to an embodiment, the sensor unit may sense at least one piece of state information among impedance information, temperature information, humidity level information, weight information, position information, and number information on the objects to be dried.

According to an embodiment, the control unit may determine an operational condition of the dryer based on the information sensed by the sensor unit, and the operational condition may include at least one of a drying condition and an evaporation condition of the objects to be dried.

According to an embodiment, when actual resistance of impedance of the objects to be dried is a preset first resistance or higher, the control unit may determine the operational condition as the drying condition of the objects to be dried and control intervals between the objects to be dried to be a preset first interval, and, when a temperature of the objects to be dried is a preset first temperature or higher, the control unit may determine the operational condition as the evaporation condition of the objects to be dried and control the intervals between the objects to be dried to be a preset second interval which is wider than the first interval.

According to an embodiment, when actual resistance of impedance of the objects to be dried is the first resistance or higher and less than a preset second resistance, the control unit may determine the drying condition as a gently drying condition, and, when actual resistance of impedance of the objects to be dried is the second resistance or higher, the control unit may determine the drying condition as an intensively drying condition.

According to an embodiment, when the operational condition of the dryer is determined as the gently drying condition, the intervals between the objects to be dried may be controlled to be the first interval, and, when the operational condition of the dryer is determined as the intensively drying condition, the intervals between the objects to be dried may be controlled to be a preset third interval which is narrower than the first interval.

According to an embodiment, the dryer may be arranged close to at least one of a washing machine, a wardrobe, and another dryer.

A dryer according to another aspect includes a main body, a drying chamber provided inside the main body and configured to accommodate objects to be dried, an electrode unit provided inside the drying chamber, a conveying unit configured to convey electrodes provided at the electrode unit, a sensor unit configured to sense information on states of the objects to be dried, and a control unit configured to control the conveying unit to move the electrodes based on the information sensed by the sensor unit.

According to an embodiment, the electrode unit may include an anode electrode and cathode electrodes disposed to be spaced apart from the anode electrode to form drying spaces at in-between portions with respect to the anode electrode.

According to an embodiment, the anode electrode and the cathode electrodes may be alternately arranged to form a plurality of drying spaces.

According to an embodiment, the electrode unit may include a first cathode electrode, an anode electrode disposed to be spaced apart from the first cathode electrode to form a first drying space at an in-between portion with respect to the first cathode electrode, and a second cathode electrode disposed to be spaced apart from the anode electrode to form a second drying space at an in-between portion with respect to the anode electrode.

According to an embodiment, when actual resistance of impedance of the objects to be dried is a preset first resistance or higher, the control unit may determine a drying condition of the objects to be dried and control intervals between the electrodes provided at the electrode unit to be a preset fourth interval, and, when a temperature of the objects to be dried is a preset first temperature or higher, the control unit may determine an evaporation condition of the objects to be dried and control the intervals between the electrodes provided at the electrode unit to be a preset fifth interval which is wider than the fourth interval.

According to an embodiment, when actual resistance of impedance of the objects to be dried is the first resistance or higher and less than a preset second resistance, the control unit may determine the drying condition as a gently drying condition, and, when actual resistance of impedance of the objects to be dried is the second resistance or higher, the control unit may determine the drying condition as an intensively drying condition.

According to an embodiment, when an operational condition of the dryer is determined as the gently drying condition, the intervals between the electrodes provided at the electrode unit may be controlled to be the fourth interval, and, when the operational condition of the dryer is determined as the intensively drying condition, the intervals between the electrodes provided at the electrode unit may be controlled to be a preset sixth interval which is narrower than the fourth interval.

According to an embodiment, the dryer may be arranged close to at least one of a washing machine, a wardrobe, and another dryer.

Next, a dryer according to still another aspect includes a main body, a drying chamber provided inside the main body and configured to accommodate objects to be dried, an electrode unit provided inside the drying chamber and comprising a plurality of electrodes, a conveying unit configured to convey the objects to be dried and the electrode unit, a sensor unit configured to sense information on states of the objects to be dried, and a control unit configured to control the conveying unit to move the objects to be dried and the electrodes based on the information sensed by the sensor unit.

According to an embodiment, the electrode unit may form a plurality of drying spaces whose sizes vary according to movements of the electrodes inside the drying chamber.

According to an embodiment, the control unit may adjust the sizes of the drying spaces based on the information sensed by the sensor unit.

According to an embodiment, the sensor unit may sense at least one piece of state information among impedance information, temperature information, humidity level information, weight information, position information, and number information on the objects to be dried.

According to an embodiment, the dryer may be arranged close to at least one of a washing machine, a wardrobe, and another dryer.

Next, a control method of a dryer according to an aspect includes sensing information on states of objects to be dried, determining an operational condition of the dryer based on the sensed state information, and controlling movements of the objects to be dried according to the determined operational condition.

According to an embodiment, the sensing of the information on states of the objects to be dried may include sensing at least one piece of state information among impedance information, temperature information, humidity level information, weight information, position information, and number information on the objects to be dried.

According to an embodiment, the controlling of the movements of the objects to be dried may include adjusting intervals between the plurality of objects to be dried accommodated in the dryer.

According to an embodiment, the determining of the operational condition of the dryer may include determining at least one of a drying condition and an evaporation condition of the objects to be dried.

According to an embodiment, the controlling of the movements of the objects to be dried may include, when actual resistance of impedance of the objects to be dried is a preset first resistance or higher, determining the operational condition as the drying condition of the objects to be dried and controlling intervals between the objects to be dried to be a preset first interval, and, when a temperature of the objects to be dried is a preset first temperature or higher, determining the operational condition as the evaporation condition of the objects to be dried and controlling the intervals between the objects to be dried to be a preset second interval which is wider than the first interval.

According to an embodiment, the determining of the operational condition of the dryer may include determining the drying condition as a gently drying condition when actual resistance of impedance of the objects to be dried is the first resistance or higher and less than a preset second resistance and determining the drying condition as an intensively drying condition when actual resistance of impedance of the objects to be dried is the second resistance or higher.

According to an embodiment, the controlling of the movements of the objects to be dried may include controlling the intervals between the objects to be dried to be the first interval when the operational condition of the dryer is determined as the gently drying condition and controlling the intervals between the objects to be dried to be a preset third interval which is narrower than the first interval when the operational condition of the dryer is determined as the intensively drying condition.

According to an embodiment, the dryer may include an electrode unit that forms a high-frequency electric field in a drying space, and the control method may further include supplying high-frequency power to the electrode unit according to the determined operational condition.

Next, a control method of a dryer according to another aspect includes sensing information on states of objects to be dried accommodated in the drying space, determining an operational condition of the dryer based on the sensed information, and controlling movements of electrodes provided at the electrode unit according to the determined operational condition.

According to an embodiment, the electrode unit may include an anode electrode and cathode electrodes disposed to be spaced apart from the anode electrode, and the control method may further include supplying high-frequency power to the anode electrode according to the set operational condition.

According to an embodiment, the sensing of the information on states of the objects to be dried may include sensing at least one piece of state information among impedance information, temperature information, humidity level information, weight information, position information, and number information on the objects to be dried.

According to an embodiment, the determining of the operational condition of the dryer may include determining at least one of a drying condition and an evaporation condition of the objects to be dried.

According to an embodiment, when the drying condition of the objects to be dried is satisfied, intervals between electrodes provided at the electrode unit may be controlled to be a preset fourth interval, and, when the evaporation condition of the objects to be dried is satisfied, the intervals between electrodes provided at the electrode unit may be controlled to be a preset fifth interval which is wider than the fourth interval.

According to an embodiment, the determining of the operational condition of the dryer may include determining as the drying condition of the objects to be dried when actual resistance of impedance of the objects to be dried is a preset first resistance or higher.

According to an embodiment, the determining of the operational condition of the dryer may include determining as a gently drying condition when actual resistance of impedance of the objects to be dried is the first resistance or higher and less than a preset second resistance and determining as an intensively drying condition when actual resistance of impedance of the objects to be dried is the second resistance or higher.

According to an embodiment, the controlling of the movements of the objects to be dried may include controlling the intervals between electrodes provided at the electrode unit to be the fourth interval when the operational condition of the dryer is determined as the gently drying condition and controlling the intervals between electrodes provided at the electrode unit to be a preset sixth interval which is narrower than the fourth interval when the operational condition of the dryer is determined as the intensively drying condition.

According to an embodiment, the determining of the operational condition of the dryer may include determining as the evaporation condition of the objects to be dried when a temperature of the objects to be dried is a preset first temperature or higher.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
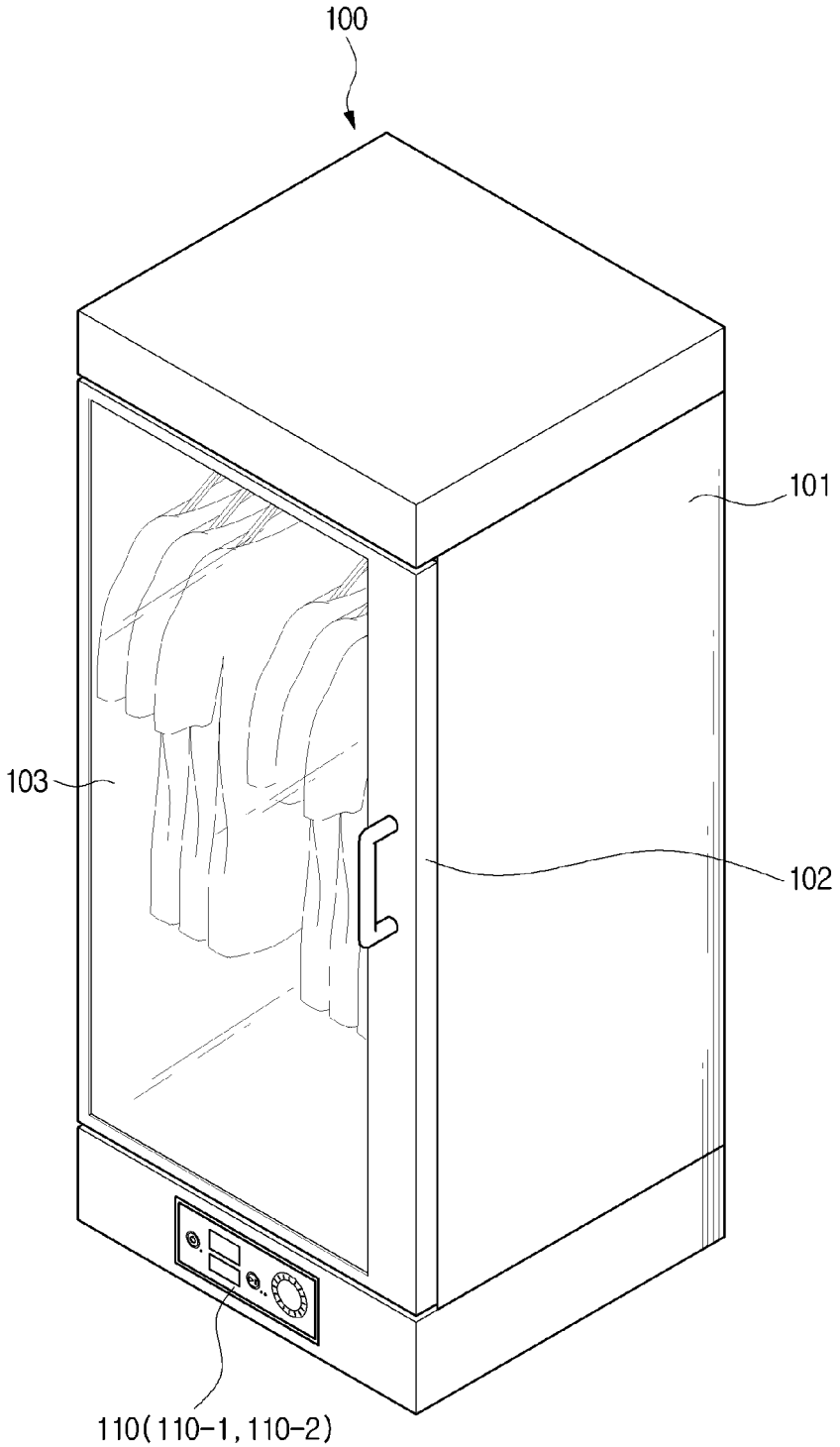
FIG. 1 is a perspective view illustrating an exterior of a clothes dryer according to an embodiment.

Reference will now be made in detail to the embodiments, examples of which are illustrated in the accompanying drawings, wherein like reference numerals refer to the like elements throughout. The embodiments are described below to explain the present invention by referring to the figures.

The present disclosure relates to a dryer and a control method thereof. A dryer is an apparatus for drying objects to be dried, and a dryer according to the present disclosure may include a clothes dryer for drying washed clothes.

A clothes dryer according to an aspect may control movements of objects to be dried based on information on states of the objects to be dried.

A clothes dryer according to another aspect may control a movement of an electrode based on information on states of objects to be dried. In this case, an electrode unit may form a plurality of drying spaces whose sizes vary according to a movement of an electrode.

A clothes dryer according to still another aspect may control movements of objects to be dried and an electrode based on information on states of the objects to be dried.

That is, in the case of the clothes dryer according to the present disclosure, only movements of objects to be dried may be controlled or only a movement of an electrode may be controlled, and according to an embodiment, the movements of the objects to be dried and the electrode may simultaneously be controlled to achieve an optimum drying performance.

Hereinafter, the clothes dryer according to the present disclosure will be described in more detail with reference to the accompanying drawings.

Figure 2:
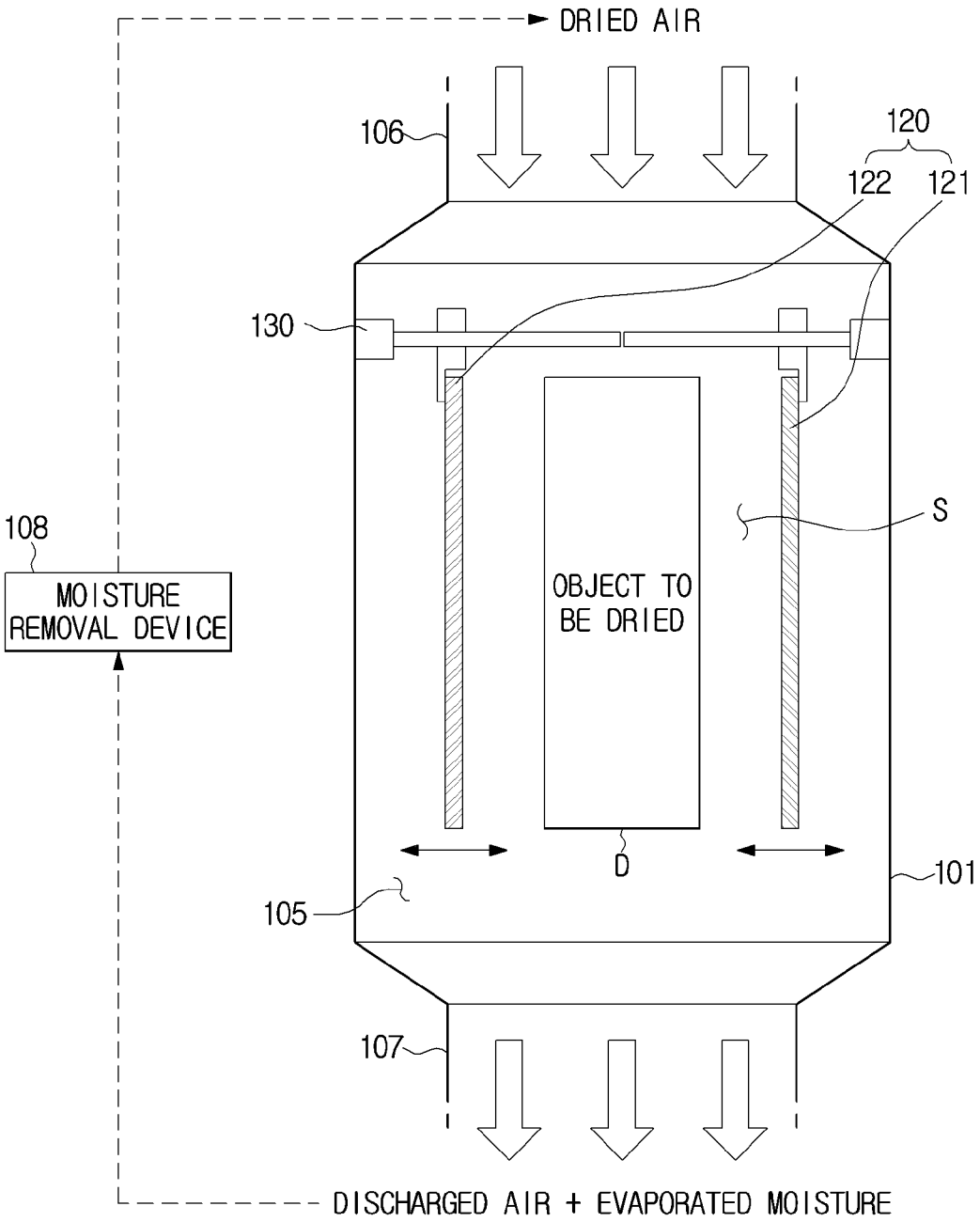
FIG. 2 is a view illustrating a cross-section of the clothes dryer according to the embodiment.
Figure 3:
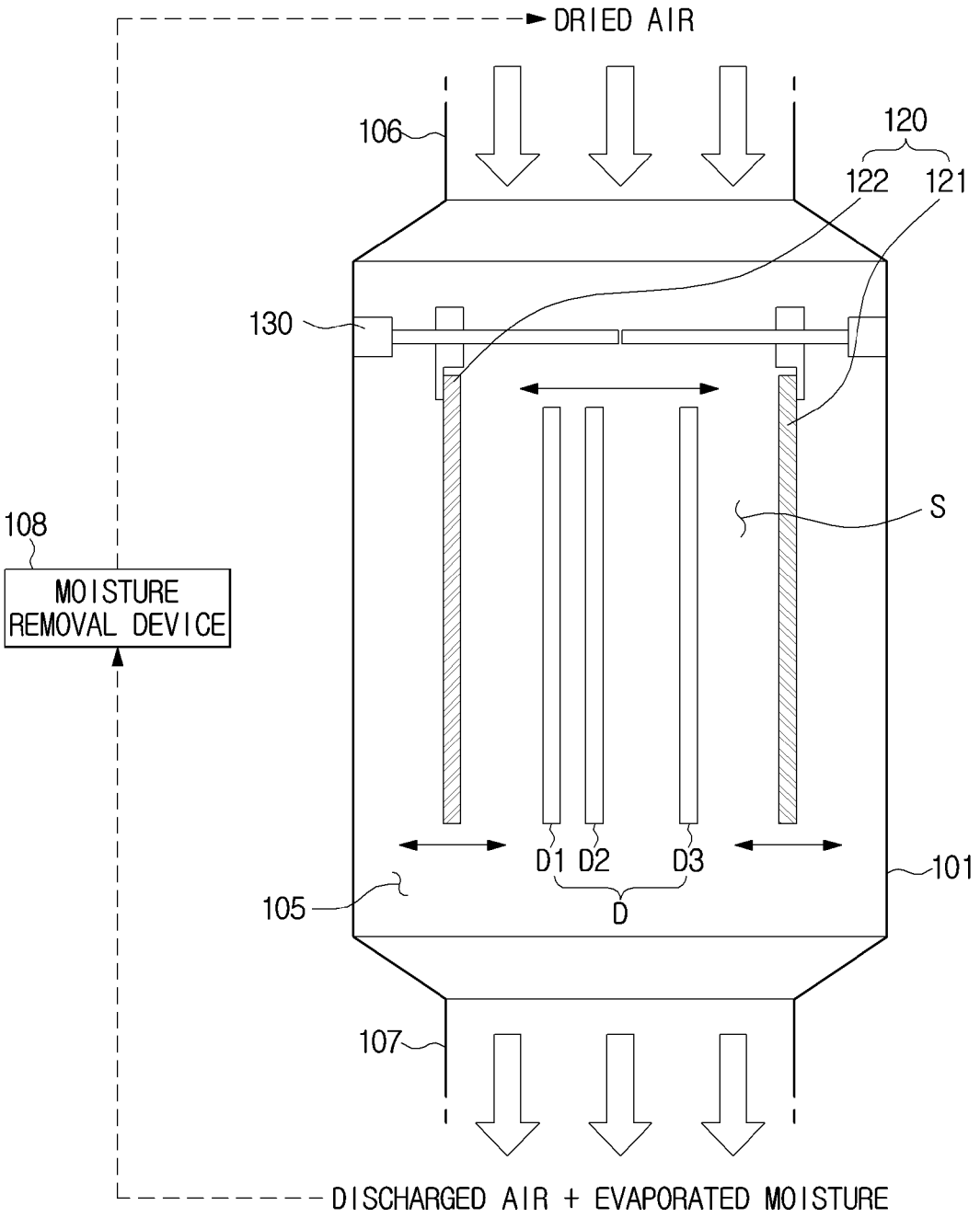
FIG. 3 is a view illustrating a cross-section of a case in which a plurality of objects to be dried are accommodated in the clothes dryer according to the embodiment.

FIG. 1 is a perspective view illustrating an exterior of a clothes dryer 100 according to an embodiment, FIG. 2 is a view illustrating a cross-section of the clothes dryer 100 according to the embodiment, and FIG. 3 is a view illustrating a cross-section of a case in which a plurality of objects to be dried (D: D1, D2, D3) are accommodated in the clothes dryer 100 according to the embodiment.

Referring to FIGS. 1 to 3, the clothes dryer 100 according to the embodiment may be provided in a form of a cabinet. The clothes dryer 100 may include a main body 101 that forms an exterior and a drying chamber 105 installed inside the main body 101 and in which drying of objects to be dried D is performed.

The main body 101 may form an exterior of the clothes dryer 100 and may be provided in a hexahedral shape. An opening through which objects to be dried may be inserted may be formed at a front portion of the main body 101, a door 102 that opens and closes the opening may be installed at one side of the front portion, and a front glass 103 may be provided at a front surface of the door 102 to allow a user to check an inner portion of the clothes dryer 100 with a naked eye.

A control panel 110 for controlling an overall operation of the clothes dryer 100 and displaying it to the user may be provided at a lower end of the main body 101. The control panel 110 may include an input unit 110-1 provided to input a control command to the clothes dryer 100 and a display unit 110-2 for displaying an operational state of the clothes dryer 100. According to an embodiment, the control panel 110 may also be installed at the front surface of the door 102 as well as the lower end of the main body 101.

The door 102 may be rotatably installed at one side of the front portion of the main body 101. When the opening of the main body 101 is closed by the door 102, the door 102 may be coupled to a lock of the door 102 provided at the main body 101. In this way, the door 102 may be provided not to be detached from the main body 101 while the clothes dryer 100 is operated.

The drying chamber 105 may be provided inside the main body 101.

An opening may be formed at a front surface of the drying chamber 105 at a position facing the opening of the main body 101. Consequently, when the door 102 of the clothes dryer 100 is opened, the objects to be dried D may move through the opening of the drying chamber 105.

An inlet duct 106 interlocked to the drying chamber 105 to feed dried air from an external flow channel or a circulating flow channel may be installed at an upper portion of the drying chamber 105, and an outlet duct 107 interlocked to the drying chamber 105 to discharge evaporated moisture evaporated from the objects to be dried D together with discharged air may be installed at a lower portion of the drying chamber 105. The dried air may be introduced into the drying chamber 105 through the inlet duct 106, and the introduced dried air may be discharged to the outside through the outlet duct 107 together with the evaporated moisture. According to an embodiment, an air exhaust fan provided to easily discharge the evaporated moisture may be mounted to surroundings of the outlet duct 107, and in this case, a flow stream of the dried air and the discharged air may be formed by rotation of the air exhaust fan. Meanwhile, the flow stream of the dried air and the discharged air is not limited to the illustrated example and may be adjusted by changing design of the inlet duct 106 and the outlet duct 107.

Meanwhile, according to an embodiment, a moisture removal device 108 may be installed at a lower end of the outlet duct 107. The moisture removal device 108 is provided to selectively remove the evaporated moisture from the discharged air discharged from the outlet duct 107.

The moisture removal device 108 may remove the evaporated moisture contained in the discharged air by a method of condensing the evaporated moisture through a heat exchange with outside air. In this case, the condensed evaporated moisture may be discharged to the outside through a separately-provided discharge pipe. Meanwhile, a method of removing the evaporated moisture contained in the discharged air is not limited to the example mentioned above and may include modifications within the scope that may easily be considered by those of ordinary skill in the art. Furthermore, the moisture removal device 108 may be detachably provided around the outlet duct 107, and thus the user may decide whether to install the moisture removal device 108 as needed.

An electrode unit 120 may be installed inside the drying chamber 105. The electrode unit 120 may include at least one anode electrode 121 and at least one cathode electrode 122. Although a case in which the electrode unit 120 includes one cathode electrode 122 and one anode electrode 121 is illustrated as an example in FIGS. 2 and 3, an example of providing the electrode unit 120 is not limited thereto.

The anode electrode 121 may be disposed to be spaced apart from the cathode electrode 122, and thus, a drying space S may be generated between the anode electrode 121 and the cathode electrode 122. Although a case in which one drying space S is formed is illustrated as an example in FIGS. 2 and 3, drying spaces S may be generated between a plurality of electrodes when the cathode electrode 122 and the anode electrode 121 are provided in a plurality.

Each of the anode electrode 121 and the cathode electrode 122 may be movably provided. According to an embodiment, the anode electrode 121 may be movably provided while the cathode electrode 122 is fixed, and the opposite thereof may also be possible.

Movements of the anode electrode 121 and the cathode electrode 122 may be adjusted so that optimum energy is transferred to the objects to be dried D. In the case of the clothes dryer 100 according to the present disclosure, a high-frequency electric field is applied to the objects to be dried D to dry the objects to be dried D. In a case of a drying technique using the high-frequency electric field, levels of uniformity and efficiency in generating an electric field around the objects to be dried D may be important.

Thus, the clothes dryer 100 according to the present disclosure may movably provide the anode electrode 121 and the cathode electrode 122 to allow optimum energy to be transferred to the objects to be dried D.

In the case of the clothes dryer 100 according to present disclosure, a high-frequency electric field may be formed by supplying high-frequency power to the anode electrode 121. In this case, a parasitic electric field may be generated in a direction of a grounding electrode at the electrode unit 120 according to relative positions of the electrode unit 120 and the grounding electrode provided around the electrode unit 120. When the parasitic electric field is generated, a portion of the electric field generated at the electrode unit 120 may disappear without being transferred to the objects to be dried D, and, as a result, this may be a cause of decreasing efficiency in drying the objects to be dried D.

In order to achieve an optimum drying performance, the parasitic electric field should be minimized and the strength of an electric field in a region where the objects to be dried D are present should be maximized. For this, an interval between electrodes that form the region where the objects to be dried D are present may be smaller than an interval between electrodes in a different region.

Generally, a larger amount of high-frequency energy is transferred to the objects to be dried D as the thickness of an air gap that exists between electrodes is thinner under a fixed oscillator frequency. In the case of the clothes dryer 100 according to the present disclosure, the same principle is applied and the interval between the electrodes that form the region where the objects to be dried D are present is controlled to be smaller than the interval between electrodes that form a different region, thereby maximizing the strength of an electric field between regions where the objects to be dried D are present. Meanwhile, when an interval by which the cathode electrode 122 and the anode electrode 121 are spaced apart is too narrow, a problem such as damage to the objects to be dried D may occur. Consequently, an interval between electrodes is preferably adjusted by considering the above.

The objects to be dried D is accommodated in the drying space S provided between the anode electrode 121 and the cathode electrode 122.

The objects to be dried D may be accommodated to allow the evaporated moisture to be efficiently discharged simultaneously as optimum energy is transferred from the electrode unit 120. For example, when one object to be dried D is accommodated in the drying space S as illustrated in FIG. 2, the object to be dried D may be accommodated in a central portion between the cathode electrode 122 and the anode electrode 121. According to an embodiment, when attempting to intensively dry a particular part of the objects to be dried D, the objects to be dried D may be accommodated to be close to the cathode electrode 122 or the anode electrode 121.

Meanwhile, referring to FIG. 3, the plurality of objects to be dried (D: D1, D2, D3) may also be accommodated in the drying space S. In this case, a flow channel may be formed between each of the objects to be dried (D: D1, D2, D3), and the size of the flow channel may vary according to an operational condition of the clothes dryer 100.

For example, intervals between the objects to be dried (D: D1, D2, D3) may be maintained to be small in a process of drying the objects to be dried D. That is, the objects to be dried (D: D1, D2, D3) may be disposed by adhering to each other or a narrow flow channel may be formed between the objects to be dried (D: D1, D2, D3), and as a result, energy may be efficiently transferred to the objects to be dried (D: D1, D2, D3). Conversely, intervals between the objects to be dried D may be maintained to be relatively large in an evaporation process of the objects to be dried D. That is, relatively wide flow channels may be formed between the objects to be dried D, and as a result, evaporated moisture evaporated from the objects to be dried D may be efficiently discharged.

A conveying unit 130 that guides movements of electrodes of the electrode unit 120 and the objects to be dried D may be installed at an upper portion of the drying chamber 105.

Figure 4:
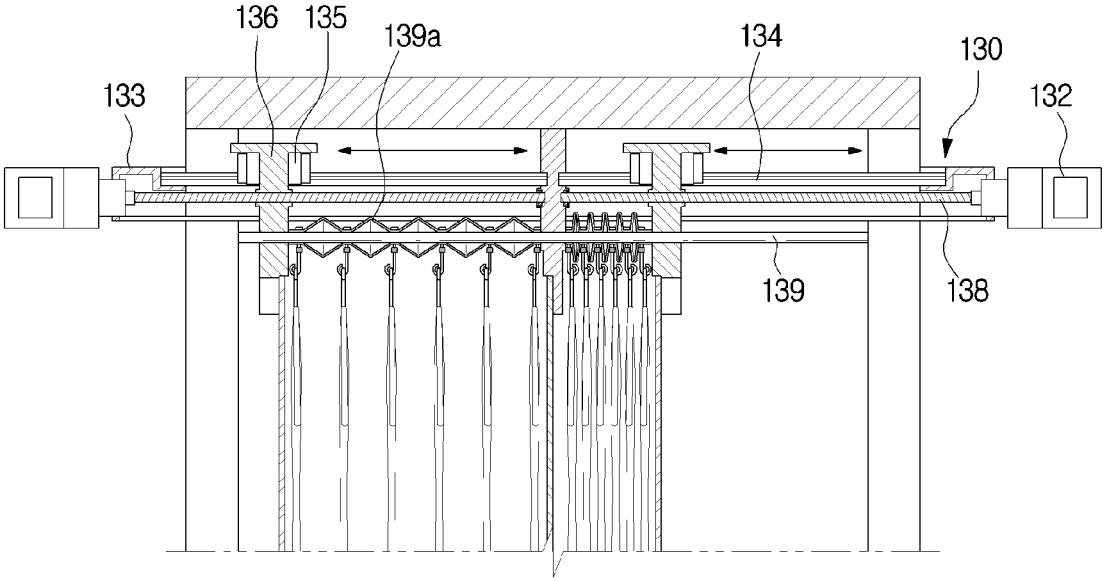
FIG. 4 is a view illustrating a structure of a conveying unit of the clothes dryer according to the embodiment.

FIG. 4 is a view illustrating a structure of the conveying unit 130 of the clothes dryer 100 according to the embodiment. The conveying unit 130 will be described in detail with reference to FIG. 4.

Referring to FIG. 4, the conveying unit 130 may include a conveying motor 132, a linear motion (LM) guide 134, a moving member 135, and a spiral shaft 138.

A support frame 133 may be coupled to one end of the conveying motor 132. The support frame 133 may be provided to support the LM guide 134 and the spiral shaft 138.

The LM guide 134 may include the moving member 135 that moves according to the LM guide 134, and an electrode support unit 136 provided to support the electrode unit 120 may be coupled to the moving member 135.

An upper end of the electrode support unit 136 may be coupled to the moving member 135, and a plurality of holes may be formed at a lower end of the electrode support unit 136 to be movable along the spiral shaft 138 and a guide bar 139. In more detail, a first hole provided to be penetrated by the spiral shaft 138 may be formed at the upper end of the electrode support unit 136, and a second hole provided to be penetrated by the guide bar 139 may be formed at the lower end of the electrode support unit.

The guide bar 139 is provided to guide movements of the electrodes of the electrode unit 120 and the objects to be dried D. An objects-to-be-dried interval adjusting device 139*a* may be installed at the guide bar 139, and a hanger on which a clothes hanger may be hung may be provided at the objects-to-be-dried interval adjusting device 139*a* to be movable together with movements of the electrodes. According to an embodiment, the object-to-be-dried interval adjusting device 139*a* may be provided in a form of a link or a form of a flexible hose, but an example of providing the object-to-be-dried interval adjusting device 139*a* is not limited thereto.

Meanwhile, although not directly illustrated in FIG. 4, according to an embodiment, the conveying unit 130 may include a plurality of LM guides. In this case, movements of the objects to be dried D and the electrodes may be controlled independently by each of the LM guides.

Next, a control configuration of the clothes dryer 100 will be described in more detail.

Figure 5:
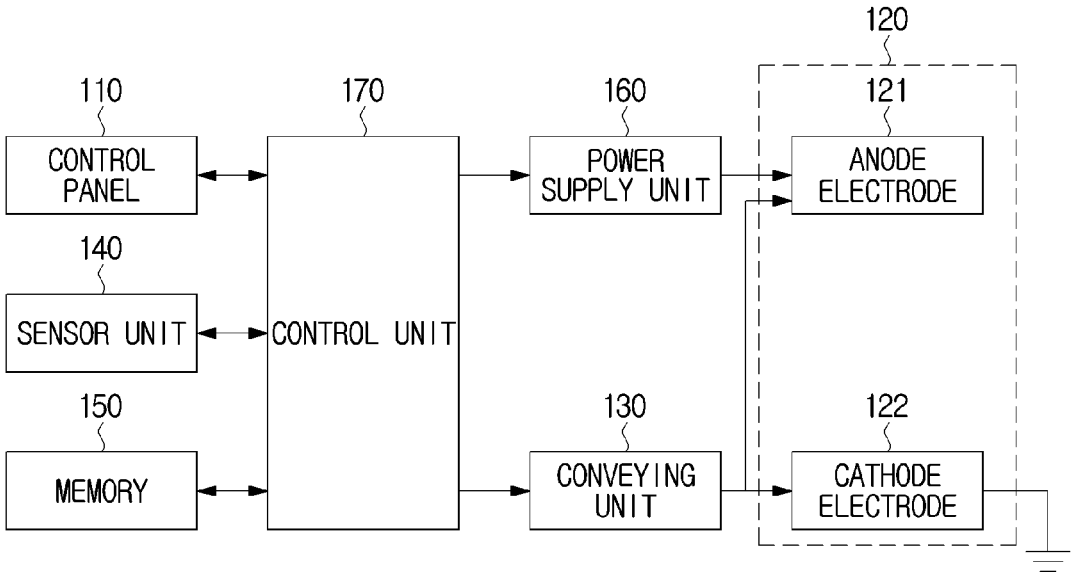
FIG. 5 is a control block diagram of the clothes dryer according to the embodiment.
Figure 6:
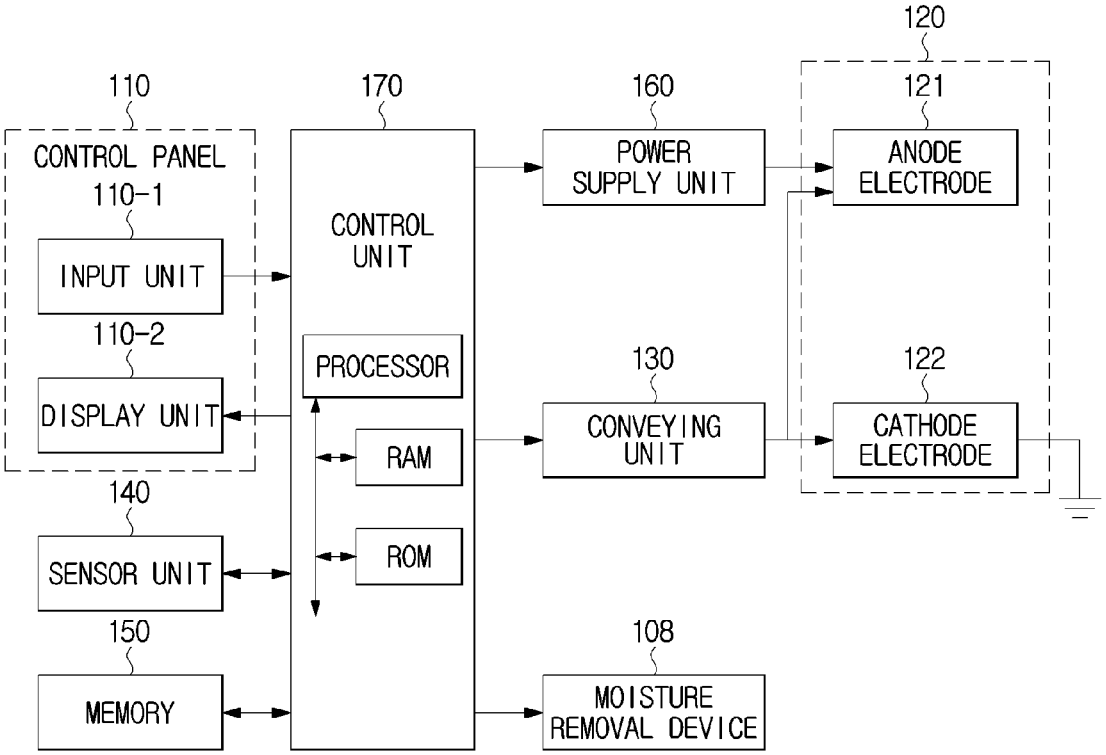
FIG. 6 is a view illustrating the control block diagram of the clothes dryer according to the embodiment in detail.

FIG. 5 is a control block diagram of the clothes dryer 100 according to the embodiment, and FIG. 6 is a view illustrating the control block diagram of the clothes dryer 100 according to the embodiment in detail.

Referring to FIGS. 5 and 6, the clothes dryer 100 according to the embodiment may include the control panel 110, a sensor unit 140, a memory 150, the electrode unit 120, a power supply unit 160, the conveying unit 130, and a control unit 170 and may further include the moisture removal device 108 according to an embodiment.

The control panel 110 is disposed for a user interface. Consequently, the control panel 110 may be disposed at a front surface of the clothes dryer 100 to be easily approached and manipulated by the user. The control panel 110 may have the input unit 110-1 that includes various types of buttons for manipulation of the user and the display unit 110-2 for providing information to the user.

Figure 7:
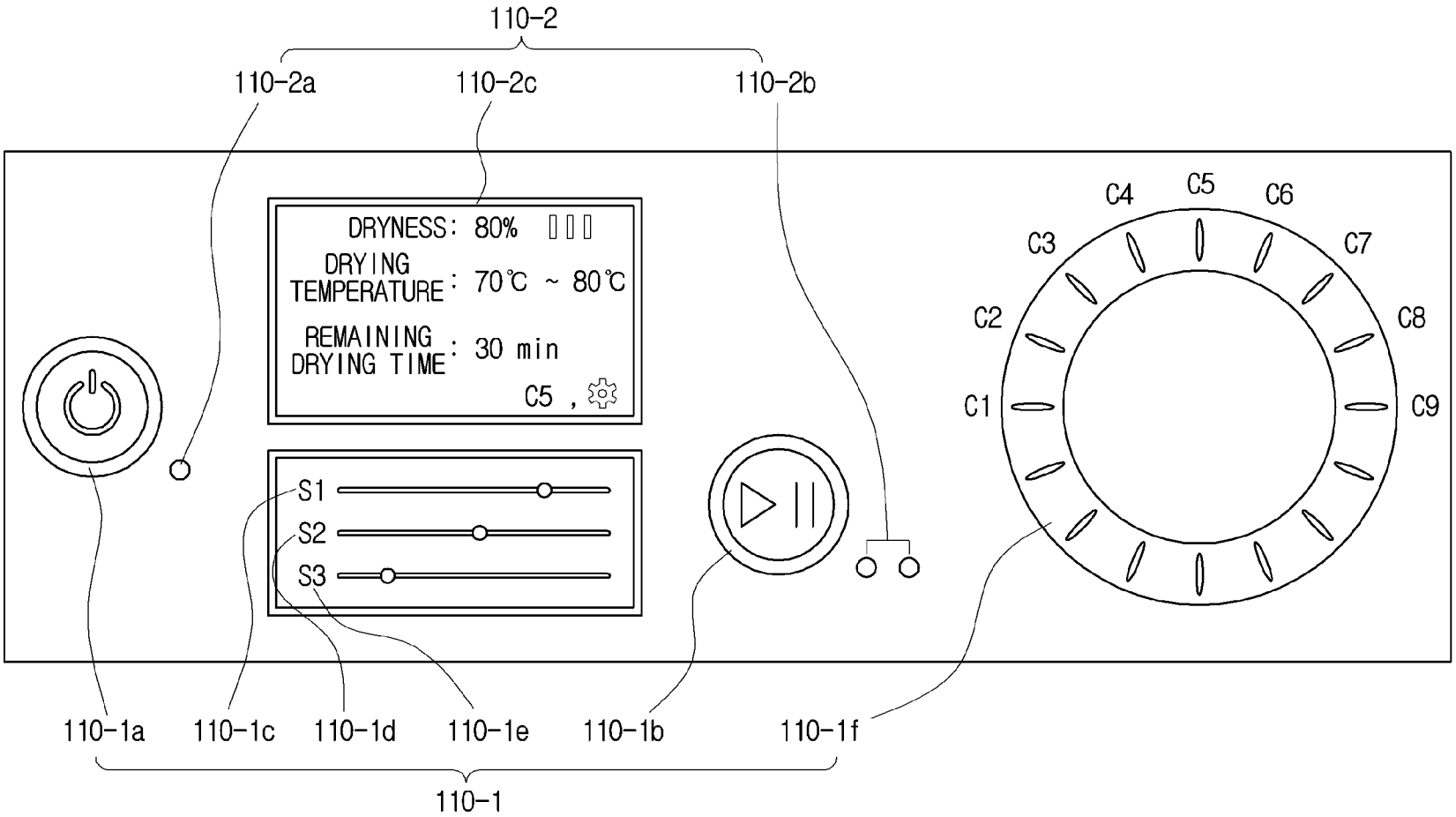
FIG. 7 is a view illustrating a control panel of the clothes dryer according to the embodiment in detail.

FIG. 7 is a view illustrating the control panel 110 of the clothes dryer 100 according to the embodiment in detail. Hereinafter, an example of a configuration of the user interface of the clothes dryer 100 will be described with reference to FIG. 7.

The input unit 110-1 may receive a control command related to the clothes dryer 100 from the user. The input unit 110-1 may receive a signal corresponding to a user's approach or a user's touch according to controlling of the control unit 170. Although the input unit 110-1 may employ a means of a proximity sensor or a means of a touch pad, an example of providing the input unit 110-1 is not limited thereto.

Referring to FIG. 7, the input unit 110-1 may include a power unit 110-1*a* that turns the clothes dryer 100 on or off and an operation unit 110-1*b* that operates the clothes dryer 100 or pauses the operation.

In addition, the input unit 110-1 may include a dryness adjusting unit 110-1*c* for adjusting dryness of the objects to be dried D, a drying temperature adjusting unit 110-1*d* for adjusting a drying temperature of the objects to be dried D, and a drying time adjusting unit 110-1*e* for adjusting a drying time of the objects to be dried D. Each of the adjusting units 110-1*c*, 110-1*d*, and 110-1*e* may be provided in a bar shape to allow the user to intuitively adjust the dryness, the drying temperature, and the drying time, etc. of the objects to be dried D.

In addition, according to an embodiment, the input unit 110-1 may also include a drying course selection unit 110-1*f* for selecting a drying course of the objects to be dried. The drying course selection unit 110-1*f* may be provided in the shape of a rotary knob, and the user may select a drying course corresponding to rotation of the rotary knob.

FIG. 7 is illustrating an example of providing the input unit 110-1, and methods of implementing the functions mentioned above are not limited to those illustrated in FIG. 7. Furthermore, the input unit 110-1 may of course provide other functions for providing convenience to the user besides the functions mentioned above.

The display unit 110-2 may display information on an operational state of the clothes dryer 100. Referring to FIG. 7, the display unit 110-2 may include a power state display unit 110-2*a* that displays whether power is applied to the clothes dryer 100 and an operational state display unit 110-2*b* that displays whether the clothes dryer 100 is operating or the operation is paused. Each of the display units 110-2*a* and 110-2*b* mentioned above may be implemented by a light-emitting diode (LED) being turned on and off, but methods of implementing the display units 110-2*a* and 110-2*b* are not limited thereto.

In addition, the display unit 110-2 may include a state display unit 110-2*c*, and the user may check a current operational state of the clothes dryer 100 through the state display unit 110-2*c*. Specifically, the user may check dryness of objects to be dried, a drying temperature, an arrangement state of the electrode unit, a remaining drying time, and a drying course of the objects to be dried, etc. through the state display unit 110-2*c*. According to an embodiment, the state display unit 110-2*c* of the clothes dryer 100 may of course display whether power is applied to the clothes dryer 100 and whether the clothes dryer 100 is operating or the operation is paused.

Although the state display unit 110-2*c* may be implemented by a liquid crystal display (LCD) panel, an LED panel, and an organic LED (OLED) panel, a means of implementing the state display unit 110-2*c* is not limited thereto.

Although a case in which the input unit 110-1 and the display unit 110-2 are separately provided is illustrated as an example in FIG. 7, an example of implementing the control panel 110 is not limited thereto, and the control panel 110 may of course employ a touch screen panel on which the input unit 110-1 and the display unit 110-2 are integrally provided.

The sensor unit 140 may sense information on a state of the objects to be dried D or an inner portion of the drying chamber 105 in order to achieve an optimum drying performance of the clothes dryer 100.

Specifically, the sensor unit 140 may sense information on a state of the objects to be dried D, e.g. information such as impedance information, temperature information, humidity information, weight information, position information, number information, and thickness information on the objects to be dried, and according to an embodiment, may directly and indirectly sense not only the information on a state of the objects to be dried D but also information such as information on a temperature of an inner portion of the drying chamber 105, humidity information, and a change in an electrical signal transmitted to the electrode unit 120. The information sensed by the sensor unit 140 may be output to the control unit 170, and the control unit 170 may control movements of the objects to be dried D and the electrodes provided at the electrode unit 120 or control the strength of high-frequency power applied to the electrode unit 120 based on the information received from the sensor unit 140.

The sensor unit 140 may include an impedance sensor.

The clothes dryer 100 according to the present disclosure employs a method of using high-frequency energy in a radio frequency (RF) domain having a wavelength of several meters or larger to dry the objects to be dried D. Hereinafter, for convenience of description, the "high-frequency energy in the RF domain of a long wavelength" may be referred to as "high-frequency energy" throughout the specification.

The high-frequency energy applied between the anode electrode 121 and the cathode electrode 122 is used to selectively heat only water molecules inside the objects to be dried, and such a heating phenomenon is shown in the same manner as a resistance component in an electric circuit.

A resistance component may be expressed by a load impedance in a high-frequency electric circuit. The load impedance is expressed using a complex number and may be shown as [Equation 1] below.

$$Z=R-j\cdot X \quad \text{[Equation 1]}$$

The real number part R in [Equation 1] represents actual resistance, and the imaginary number part X represents reactance. Generally, reactance obstructs a current flow but does not consume power. Thus, actually-consumed power is related to the actual resistance value R of impedance, and this is referred to as "effective power."

Generally, an actual resistance value of load impedance increases as an amount of water capable of absorbing high-frequency energy between the anode electrode 121 and the cathode electrode 122 is larger. This signifies that an electrical resistance value may increase and consumed power may be higher as the amount of water capable of absorbing the high-frequency energy between the anode electrode 121 and the cathode electrode 122 is larger.

Figure 8:
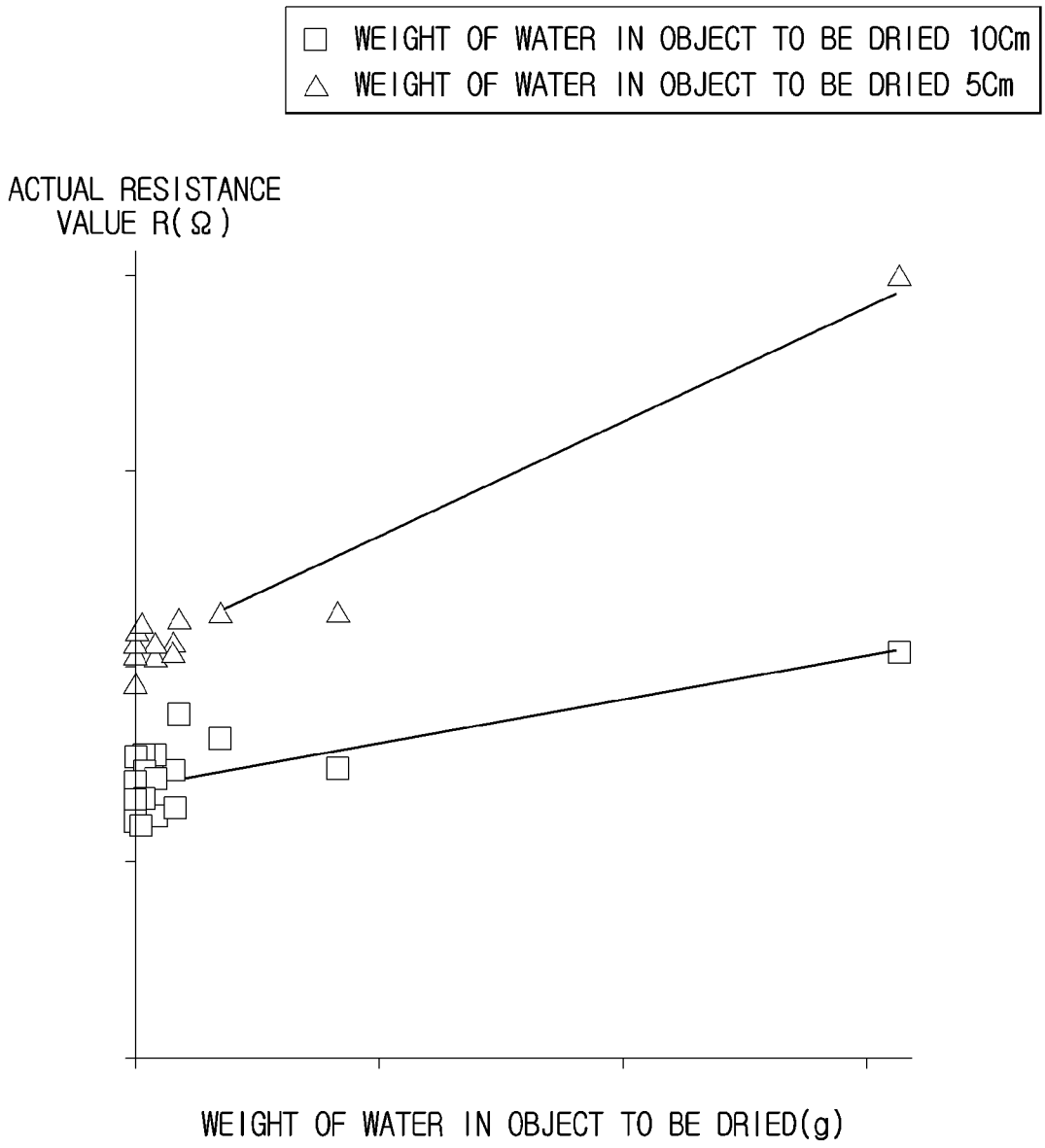
FIG. 8 is a view illustrating a change in a load impedance value according to a weight of water within objects to be dried.

FIG. 8 is a view illustrating a change in a load impedance value according to a weight of water within the objects to be dried D. A horizontal axis in FIG. 8 represents a weight of water within the objects to be dried D, and a vertical axis in FIG. 8 represents an actual resistance value of load impedance.

Referring to FIG. 8, a phenomenon in which the actual resistance value of the load impedance increases as the amount of water within the objects to be dried D is larger can be confirmed. In addition, a phenomenon in which the actual resistance value of the load impedance increases as the interval between the cathode electrode 122 and the anode electrode 121 is smaller may be confirmed.

In other words, as the amount of water within the objects to be dried D is larger, a phenomenon in which the load impedance value increases as the interval between the electrodes is smaller is observed. This signifies that the objects to be dried D may be more efficiently dried as the interval between the anode electrode 121 and the cathode electrode 122 is smaller.

The impedance sensor may sense information on the actual resistance value of the load impedance according to the weight of water within the objects to be dried D to transmit the information to the control unit 170, and the control unit 170 may control the interval between the electrodes 121 and 122 provided at the electrode unit 120 or determine a point at which drying of the objects to be dried D will be finished based on the information on impedance of the objects to be dried D received from the impedance sensor.

In addition, the sensor unit 140 may include a temperature sensor.

The temperature sensor may be installed inside the drying chamber 105 to sense information on a temperature of the objects to be dried D or information on a temperature of the inner portion of the drying chamber 105 or may be installed in the outlet duct 107 to sense information on a temperature of discharged air.

The temperature sensor may be implemented with a contact type temperature sensor or a non-contact type temperature sensor. Specifically, the temperature sensor may include at least one of a resistance-temperature-detector (RTD) temperature sensor that uses a change in resistance of metal according to a temperature change, a thermistor temperature sensor that uses a change in resistance of a semiconductor according to a temperature change, a thermocouple temperature sensor that uses an electromotive force generated at both ends of a junction of two types of metallic lines formed with different materials, and an integrated circuit (IC) temperature sensor that uses voltages at both ends of a transistor that change according to a temperature or current and voltage features of a P-N junction, and according to an embodiment, may include an optical fiber sensor. However, an example of providing the temperature sensor is not limited thereto and may include modifications within in the scope that may be easily considered by those of ordinary skill in the art.

In addition, the sensor unit 140 may include a humidity sensor.

The humidity sensor may be installed inside the drying chamber 105 to sense information on a moisture content of the objects to be dried D or may be installed in the outlet duct 107 to sense humidity information on evaporated moisture contained in discharged air.

In addition, the sensor unit 140 may also include a weight sensor that detects the weight of the objects to be dried D or include a position sensor that detects a position of the objects to be dried D. Meanwhile, an example of an employable sensor is not limited to those mentioned above and may include modifications within the scope that may be easily considered by those of ordinary skill in the art.

The memory 150 may store various data, programs, or applications for driving and controlling the clothes dryer 100. For example, the memory 150 may store the information sensed by the sensor unit 140 and may store information related to a means of controlling the electrode unit 120 and information related to a drying means according to a type of the objects to be dried D, etc. based on the information sensed by the sensor unit 140. As well as the above, the memory 150 may store information such as a control program for controlling the clothes dryer 100, an exclusive application initially provided by a manufacturer, or a universal application downloaded from an external source.

The memory 150 may be implemented by a nonvolatile memory device such as a read-only memory (ROM), a programmable ROM (PROM), an erasable PROM (EPROM), and a flash memory, a volatile memory device such as a random access memory (RAM), or a storage device such as a hard disc or an optical disc. Furthermore, the memory may be provided independently of a ROM and a RAM included in the control unit and, according to an embodiment, may be a configuration included in the control unit.

The moisture removal device 108 is disposed at a lower end of the outlet duct 107 of the clothes dryer 100 to selectively remove evaporated moisture contained in discharged air. The moisture removal device 108 may include a condenser that condenses the evaporated moisture by a heat exchange with outside air, but a means of removing the evaporated moisture contained in the discharged air is not limited thereto.

The moisture removal device 108 may start to operate when a humidity level of the discharged air containing the evaporated moisture has reached a preset humidity level, and according to an embodiment, the operation of the moisture removal device 108 may also be manually started by a user's manipulation.

The electrode unit 120 may include at least one cathode electrode 122 and at least one anode electrode 121, and at least one object to be dried D may be disposed between the cathode electrode 122 and the anode electrode 121.

The electrode unit 120 may receive high-frequency power via the power supply unit 160 according to controlling of the control unit 170. In more detail, the anode electrode 121 of the electrode unit 120 may receive the high-frequency power via the power supply unit 160 according to the controlling of the control unit 170, and the cathode electrode 122 may serve as a grounding electrode.

The electrode unit 120 may apply the high-frequency energy received via the power supply unit 160 to the objects to be dried D in order to dry the objects to be dried D. Here, as mentioned above, the high-frequency energy is the high-frequency energy in the RF domain having a wavelength of several meters or larger.

Generally, when the wavelength of the high-frequency energy applied to the objects to be dried D is shorter than the width of the drying space S provided inside the drying chamber 105, the electromagnetic wave energy radiated into the drying space S may cause resonance and the energy may be concentrated to a particular position. As a result, a thermal runaway phenomenon may occur in the drying chamber 105 or non-uniform heating of the objects to be dried D in the space may occur, and according to circumstances, fire may be caused due to electric field concentration and overheating of a metal object. Furthermore, since a depth in which energy penetrates into the objects to be dried D is only several centimeters and shallow due to the short wavelength, it may be difficult to efficiently dry the objects to be dried D.

Thus, the clothes dryer 100 according to the embodiment may use the high-frequency energy having a long wavelength to prevent the energy concentration phenomenon within the space due to resonance, and danger of discharge caused by an insertion of a metal object may be removed. Furthermore, the depth in which energy penetrates into the objects to be dried D also deepens, and the objects to be dried D may be efficiently dried.

In the clothes dryer 100 using high-frequency energy, the high-frequency energy is uniformly supplied around the objects to be dried D to improve the drying performance. Thus, in the clothes dryer 100 according to the embodiment, movements of the objects to be dried D and the electrodes provided at the electrode unit 120 are controlled based on the information sensed by the sensor unit 140, thereby simultaneously taking an advantage of using high-frequency energy having a long wavelength and achieving the maximum drying performance.

The control unit 170 controls the overall operation of the clothes dryer 100 and signal flows between inner elements of the clothes dryer 100 and processes data. When input by the user or a preset condition is satisfied, the control unit 170 may execute an operating system (OS) and various applications stored in the memory 150.

When a command to control an operation of the clothes dryer 100 is input by the user, the control unit 170 may control movements of the objects to be dried D and the electrodes provided at the electrode unit 120 and control the strength of high-frequency power applied to the electrode unit 120.

Specifically, when the command to control an operation of the clothes dryer 100 is input by the user, the control unit 170 may output a control signal to the sensor unit 140 to control the sensor unit 140 to sense information on a state of the objects to be dried D.

When the sensor unit 140 receives a control command to sense the information on a state of the objects to be dried D from the control unit 170, the sensor unit 140 may sense the information on a state of the objects to be dried D. Specifically, the sensor unit 140 may sense state information such as impedance information, temperature information, humidity level information, weight information, position information, number information, and thickness information on the objects to be dried D and transmit the state information to the control unit 170. According to an embodiment, the sensor unit 140 may also sense various pieces of information required in controlling an operation of the clothes dryer 100 including information on a state of the inner portion of the drying chamber 105 as well as the information on a state of the objects to be dried D and output the various pieces of information to the control unit 170. Hereinafter, for convenience of description, a case in which the sensor unit 140 senses the information on a state of the objects to be dried D and transmits the information to the control unit 170 will be described as an example.

The control unit 170 may determine an operational condition of the clothes dryer 100 based on the information sensed by the sensor unit 140. Here, the operational condition of the clothes dryer 100 may include at least one of a "drying condition of the objects to be dried D" and an "evaporation condition of the objects to be dried D."

Here, the "drying condition of the objects to be dried D" is a condition for allowing the objects to be dried D accommodated in the clothes dryer 100 to be optimally dried and may include a condition on positions of the electrodes provided at the electrode unit 120, a condition on positions of the objects to be dried D, and a condition on a strength of the high-frequency power applied to the electrode unit 120. In addition, the "evaporation condition of the objects to be dried D" is a condition for allowing evaporated moisture evaporated from the objects to be dried D to be easily discharged and may include the condition on positions of the electrodes provided at the electrode unit 120, the condition on positions of the objects to be dried D, and the condition on a strength of the high-frequency power applied to the electrode unit 120.

Examples of setting the drying condition of the objects to be dried D and the evaporation condition of the objects to be dried D by the control unit 170 are described below.

When actual resistance of impedance of the objects to be dried D is a preset first resistance or higher according to a result of detection by the sensor unit 140, the control unit 170 may determine as the drying condition of the objects to be dried D. When actual resistance of impedance of the objects to be dried D is the preset first resistance or higher and less than a preset second resistance according to the result of detection by the sensor unit 140, the control unit 170 may determine as a gently drying condition. When actual resistance of impedance of the objects to be dried D is the preset second resistance or higher, the control unit 170 may determine as an intensively drying condition.

When a temperature of the objects to be dried D is a preset first temperature or higher according to the result of detection by the sensor unit 140, the control unit 170 may determine as the evaporation condition of the objects to be dried D. Here, the first temperature may be determined to vary according to the type, the weight, the number, or the like of the objects to be dried D. By the above controlling, the control unit 170 prevents the temperature of the objects to be dried D from rising above a preset temperature, thereby simultaneously preventing clothes from being damaged and achieving the optimum drying performance.

An example of determining the drying condition or the evaporation condition of the objects to be dried D is not limited to that mentioned above and may include modifications within the scope that may be easily realized by those of ordinary skill in the art.

According to a determined operational condition of the clothes dryer 100, the control unit 170 may control movements of the electrodes provided at the electrode unit 120, control movements of the objects to be dried D, or, according to an embodiment, may also simultaneously control the movements of the electrodes provided at the electrode unit 120 and the objects to be dried D.

As the operation of the clothes dryer 100 progresses, the control unit 170 may determine an operational condition of the clothes dryer 100 in predetermined intervals, and in this case, the operation of the clothes dryer 100 may be controlled according to the determined operational condition. In other words, the operation of drying the objects to be dried D and the operation of discharging evaporated moisture may be repeatedly performed according to an operational condition of the clothes dryer 100 determined by the control unit 170.

Examples of controlling the movements of the objects to be dried D and the electrodes at the electrode unit 120 by the control unit 170 are as follows. Hereinafter, a case in which the plurality of objects to be dried (D: D1, D2, D3) are accommodated in the drying space S will be described as an example, and an example of controlling an interval between the electrodes provided at the electrode unit 120 when the plurality of objects to be dried (D: D1, D2, D3) are accommodated may be analogically applied to the case in which one object to be dried D is accommodated in the drying space as illustrated in FIG. 2.

When the plurality of objects to be dried (D: D1, D2, D3) are accommodated in the drying space S, positions of the electrodes provided at the electrode unit 120 and positions between the objects to be dried (D: D1, D2, D3) may be controlled toward achieving an optimum drying performance.

The control unit 170 may control an interval between the electrodes provided at the electrode unit 120 to be a preset fourth interval when an operational condition of the clothes dryer 100 is the drying condition of the objects to be dried D and may control an interval between the electrodes provided at the electrode unit 120 to be a preset fifth interval when an operational condition of the clothes dryer 100 is the evaporation condition of the objects to be dried D. Here, the fifth interval represents an interval wider than the fourth interval. The control unit 170 may adjust an interval between the electrodes provided at the electrode unit 120 to be wide under the evaporation condition of the objects to be dried D to easily adjust intervals between the objects to be dried (D: D1, D2, D3).

According to an embodiment, the control unit 170 may control an interval between the electrodes to be the fourth interval mentioned above when an operational condition of the clothes dryer 100 is the gently drying condition and may control an interval between the electrodes to be a preset sixth interval which is narrower than the fourth interval when an operational condition of the clothes dryer 100 is the intensively drying condition. For the objects to be dried (D: D1, D2, D3) to be intensively dried, a strong electric field should be formed in the drying space S. Generally, by maintaining an interval between the electrodes to be narrow, the size of the parasitic electric field generated according to a relative position with respect to a grounding electrode nearby can be minimized and the strength of the electric field in the drying space S where the objects to be dried (D: D1, D2, D3) are present can be maximized at the same time. In other words, by forming an interval between the electrodes to be narrow, the control unit 170 may control optimum energy to be transferred to the objects to be dried (D: D1, D2, D3).

According to an embodiment, an operational condition of the clothes dryer 100 may be subdivided into a plurality of drying conditions including the gently drying condition and the intensively drying condition, and in this case, an interval between the electrodes provided at the electrode unit 120 may be controlled according to each of the drying conditions.

The control unit 170 may control intervals between the objects to be dried (D: D1, D2, D3) to be a preset first interval when an operational condition of the clothes dryer 100 is the drying condition of the objects to be dried (D: D1, D2, D3) and may control intervals between the objects to be dried (D: D1, D2, D3) to be a preset second interval when an operational condition of the clothes dryer 100 is the evaporation condition of the objects to be dried (D: D1, D2, D3). Here, the second interval represents an interval wider than the first interval. The control unit 170 may adjust intervals between the objects to be dried (D: D1, D2, D3) to be wide under the evaporation condition of the objects to be dried (D: D1, D2, D3) to control evaporated moisture evaporated from the objects to be dried (D: D1, D2, D3) to be easily discharged.

According to an embodiment, the control unit 170 may control intervals between the objects to be dried (D: D1, D2, D3) to be the first interval mentioned above when an operational condition of the clothes dryer 100 is the gently drying condition and may control intervals between the objects to be dried (D: D1, D2, D3) to be a preset third interval which is narrower than the first interval when an operational condition of the clothes dryer 100 is the intensively drying condition. For the objects to be dried (D: D1, D2, D3) to be intensively dried, a strong electric field should be formed in the drying space S. Consequently, the control unit 170 may maximize the strength of the electric field in the drying space S in which the objects to be dried (D: D1, D2, D3) are accommodated by simultaneously adjusting an interval between the electrodes provided at the electrode unit 120 and forming intervals between the objects to be dried (D: D1, D2, D3) to be narrow.

According to an embodiment, an operational condition of the clothes dryer 100 may be subdivided into a plurality of drying conditions including the gently drying condition and the intensively drying condition, and in this case, intervals between the objects to be dried D may be controlled according to each of the drying conditions.

The control unit 170 may determine whether to apply high-frequency power to the electrode unit 120 and control the strength of the high-frequency power applied to the electrode unit 120 when the high-frequency power is being applied.

Specifically, the control unit 170 may output a control signal to the power supply unit 160 to apply power to the anode electrode 121. The control unit 170 may apply power to the anode electrode 121 when an operational condition of the clothes dryer 100 is a drying condition and may block power applied to the anode electrode 121 when an operational condition of the clothes dryer 100 is an evaporation condition.

In addition, when an operational condition of the clothes dryer 100 is the drying condition, the control unit 170 may adjust the strength of high-frequency power applied to the anode electrode 121 to control the strength of a high-frequency electric field formed in the drying space S.

According to an embodiment, the control unit 170 may control the strength of high-frequency power applied to the anode electrode 121 to be a preset first strength when an operational condition of the clothes dryer 100 is the gently drying condition and may control the strength of high-frequency power applied to the anode electrode 121 to be a preset second strength which is stronger than the first strength mentioned above when an operational condition of the clothes dryer 100 is the intensively drying condition. For the objects to be dried (D: D1, D2, D3) to be intensively dried, a strong electric field should be formed in the drying space S. Consequently, the control unit 170 may control a strong electric field to be formed in the drying space S by applying a strong, high-frequency electric field to the anode electrode 121.

Hereinafter, in relation to the detailed example of controlling by the control unit 170, a method of controlling positions of the electrodes provided at the electrode unit 120 and the objects to be dried D based on temperature information on of the objects to be dried D will be described.

Figure 9:
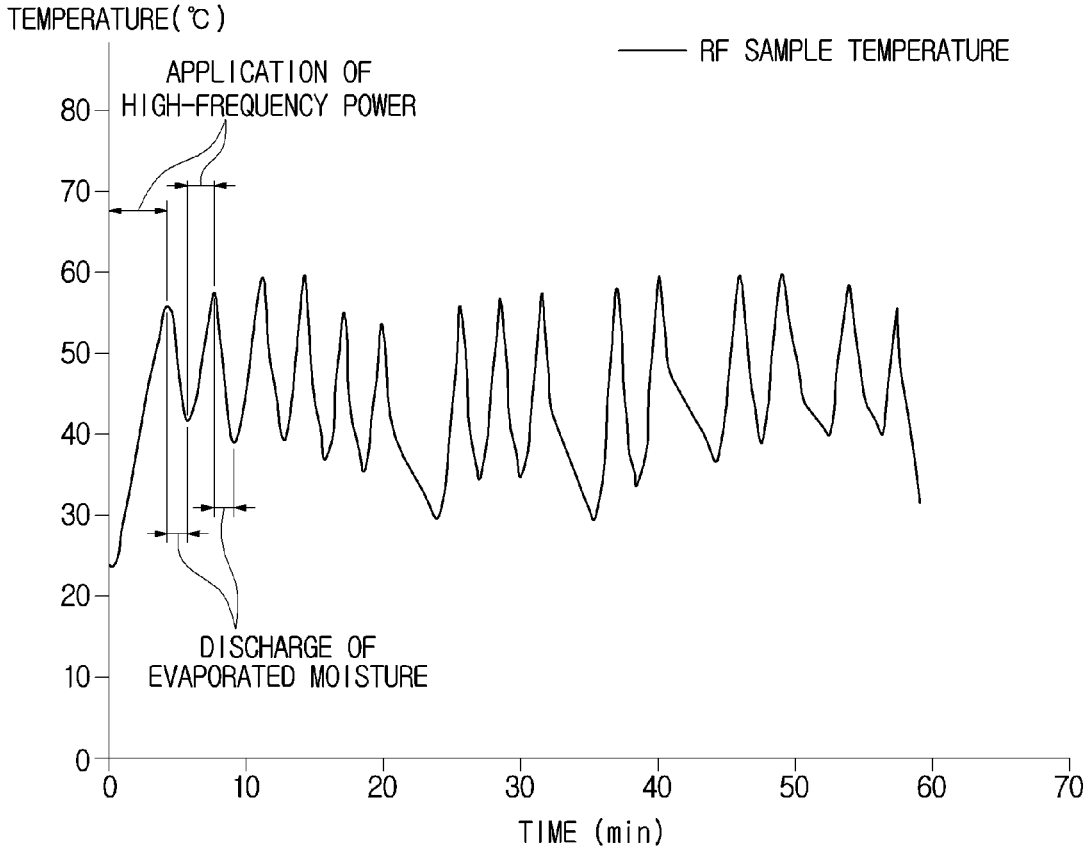
FIG. 9 is a view illustrating an example of a method of controlling an operation of the clothes dryer based on temperature information on objects to be dried.

FIG. 9 is a view illustrating an example of a method of controlling an operation of the clothes dryer 100 based on temperature information on objects to be dried.

When the objects to be dried D are objects weaved by wool or rayon fiber, the objects to be dried D may be damaged due to shrinkage and deformation of cloth when the objects to be dried D are heated to a particular temperature or higher. Consequently, when the objects to be dried D are being dried, the temperature of the objects to be dried D should be maintained at a particular temperature or lower. Thus, as illustrated in FIG. 9, temperature information on the objects to be dried D may be sensed from the temperature sensor installed in the drying chamber 105, and the sensed temperature information may be used to perform a process of drying the objects to be dried D while keeping the temperature of the objects to be dried D at a particular temperature or lower.

Specifically, the control unit 170 may sense temperature information on the objects to be dried D from the temperature sensor installed nearby the objects to be dried D during the drying operation. The temperature sensor may sense the temperature information on the objects to be dried D in preset time intervals according to the controlling of the control unit 170 and output the sensed temperature information to the control unit 170.

When the temperature of the objects to be dried D is the preset first temperature or lower based on the temperature information on the objects to be dried D received from the temperature sensor, the control unit 170 may adjust an interval between the electrodes provided at the electrode unit 120 to be narrow and apply high-frequency power to the electrode unit 120. According to an embodiment, when the plurality of objects to be dried (D: D1, D2, D3) are accommodated in the drying space S, intervals between the objects to be dried (D: D1, D2, D3) may also be adjusted to be narrow. The temperature of the objects to be dried D may rise as the high-frequency energy is supplied to the objects to be dried D, and thus the process of drying the objects to be dried D may be performed.

Meanwhile, when the temperature of the objects to be dried D rises above the first temperature as the process of drying the objects to be dried D progresses, the objects to be dried D may be damaged. Consequently, the high-frequency power applied to the electrode unit 120 may be blocked and an interval between the electrodes provided at the electrode unit 120 may be adjusted to be wide in order to keep the temperature of the objects to be dried D at a particular temperature or lower. According to an embodiment, the electrodes provided at the electrode unit 120 may be restored to initially-arranged states, and, when the plurality of objects to be dried (D: D1, D2, D3) are accommodated in the drying space S, intervals between the objects to be dried D may also be adjusted to be wide. In this manner, the temperature of the objects to be dried D may be prevented from continuously rising, and evaporated moisture generated in the process of drying the objects to be dried D may be easily discharged.

In the case of the clothes dryer 100 according to the present disclosure, controlling by the above means may be performed cyclically, and thus, an optimum drying performance may be achieved.

In the above, the clothes dryer 100 according to one embodiment has been described.

In the clothes dryer 100 according to the present disclosure, a configuration of the electrode unit 120 may be modified in various ways to improve efficiency of drying the objects to be dried D. Specifically, arrangements of the cathode electrode 122 and the anode electrode 121 may be adjusted, and the form and the number thereof may be modified in various ways. Hereinafter, various modified embodiments of the clothes dryer 100 including modified examples of the electrode unit 120 will be described.

Figure 10:
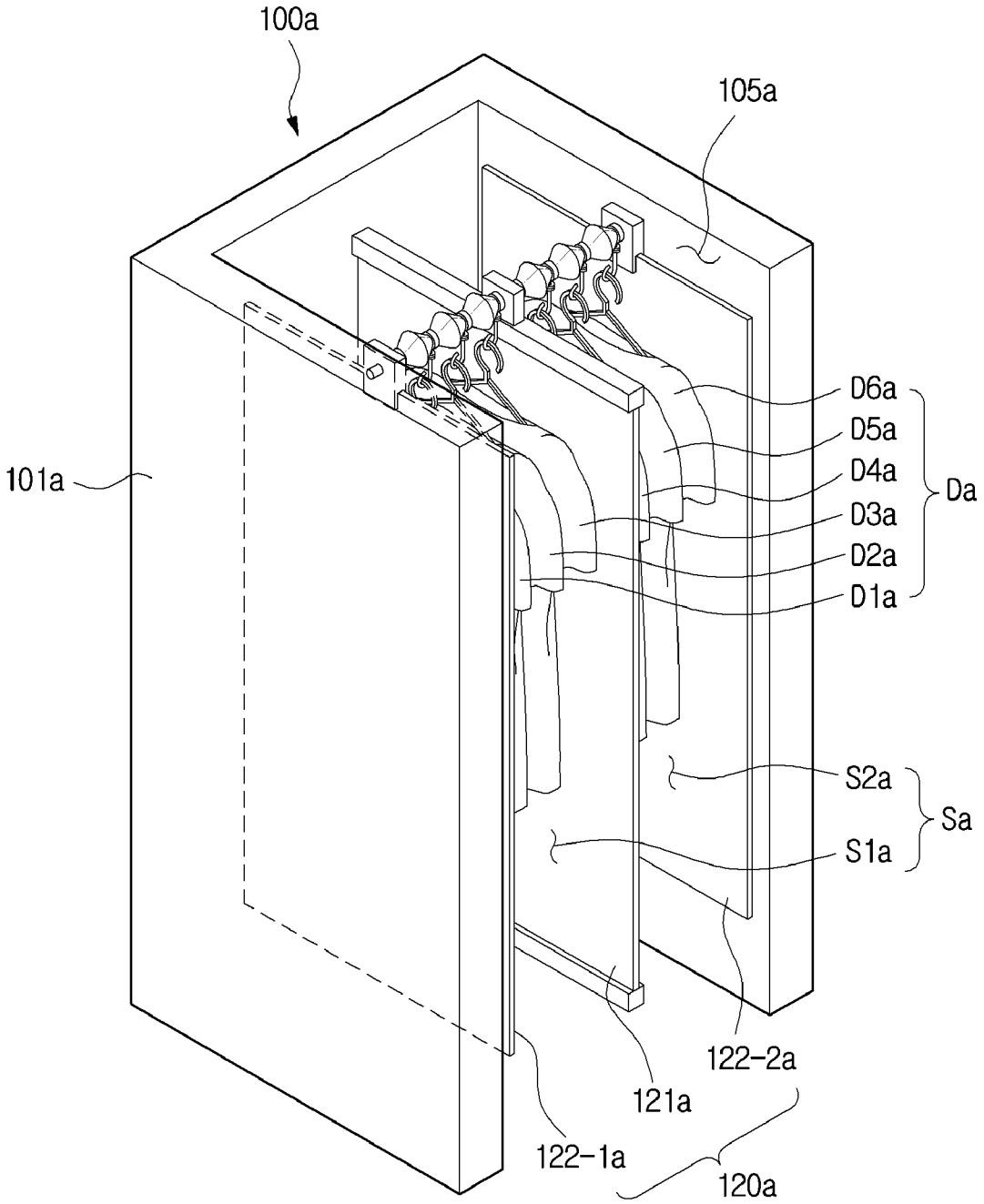
FIG. 10 is a perspective view illustrating a clothes dryer according to another embodiment.
Figure 11:
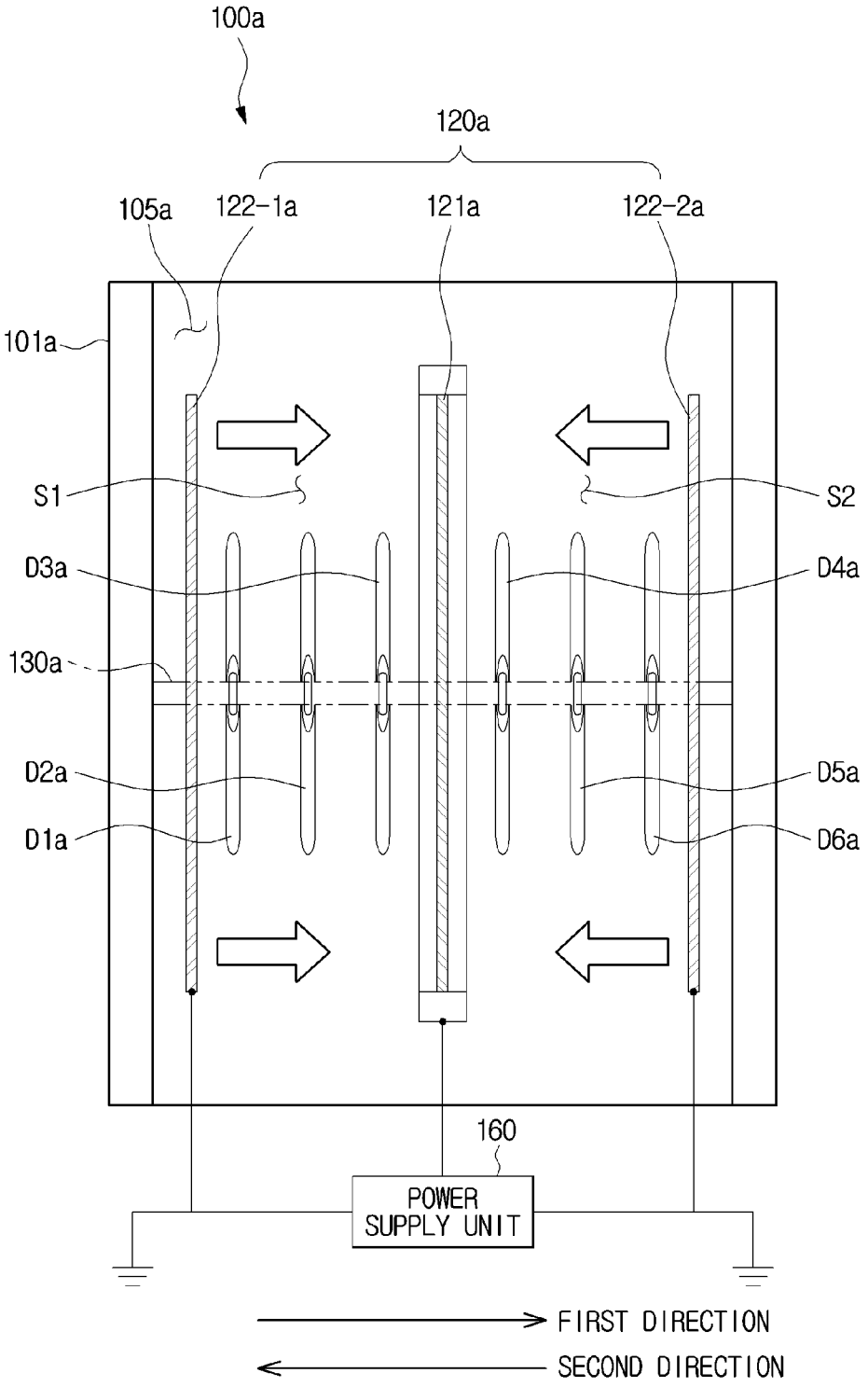
FIGS. 11 and 12 are views illustrating an operational process of the clothes dryer according to FIG. 10.
Figure 12:
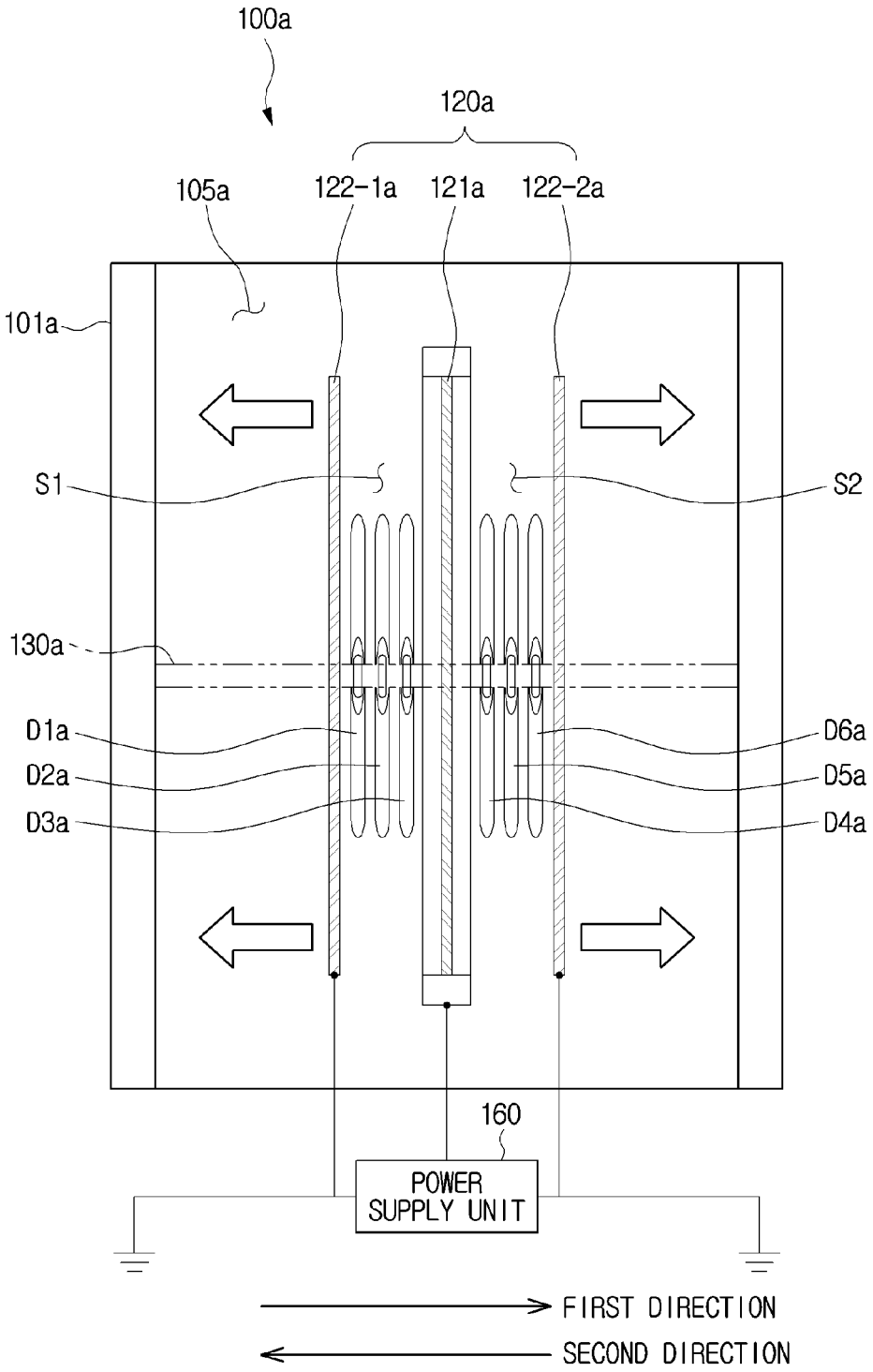

FIG. 10 is a perspective view illustrating a clothes dryer 100*a* according to another embodiment, and FIGS. 11 and 12 are views illustrating an operational process of the clothes dryer 100*a* according to FIG. 10.

Referring to FIG. 10, in a case of the clothes dryer 100*a* according to the embodiment, configurations such as a main body 101*a*, a drying chamber 105*a*, and a conveying unit 130*a* are similar to those of the clothes dryer 100 illustrated in FIGS. 1 to 4. However, differences exist in terms of the number and the arrangement forms of electrodes, and hereinafter, differences from the clothes dryer 100 according to FIGS. 1 to 4 will be mainly described.

An electrode unit 120*a* of the clothes dryer 100*a* according to the embodiment may include an anode electrode 121*a* and a plurality of cathode electrodes 122-1*a* and 122-2*a* disposed to be spaced apart from the anode electrode 121*a* to form drying spaces (Sa: S1*a*, S2*a*) at in-between portions with the anode electrode 121*a*.

Specifically, the electrode unit 120*a* may include a first cathode electrode 122-1*a*, the anode electrode 121*a* disposed to be spaced apart from the first cathode electrode 122-1*a* to form a first drying space S1*a* at an in-between portion with the first cathode electrode 122-1*a*, and a second cathode electrode 122-2*a* disposed to be spaced apart from the anode electrode 121*a* to form a second drying space S2*a* at an in-between portion with the anode electrode 121*a*. In other words, with respect to one anode electrode 121*a*, the cathode electrodes 122-1*a* and 122-2*a* may be respectively disposed at both sides of the anode electrode 121*a*.

By the above arrangement of the electrodes, the clothes dryer 100*a* according to the present disclosure may not only minimize energy loss caused by a parasitic electric field generated in a region where objects to be dried are not present but may also form a drying region in which objects to be dried are accommodated to be wide. Furthermore, by arranging the electrode unit 120 in an order of the first cathode electrode 122-1*a*, the anode electrode 121*a*, and the second cathode electrode 122-2*a*, intervals between the electrodes with respect to the same object to be dried may be reduced to half compared to a case in which the electrode unit 120*a* is arranged in an order of the cathode electrodes and the anode electrode. As a result, by applying a stronger high-frequency electric field to objects to be dried, a drying performance of the clothes dryer 100*a* may be improved.

The anode electrode 121*a* of the electrode unit 120*a* according to the embodiment is an electrode to which high-frequency power is applied and may be provided to have a fixed position, and the first cathode electrode 122-1*a* and the second cathode electrode 122-2*a* are grounding electrodes and may be provided to be movable.

By the anode electrode 121*a* provided to have a fixed position, the clothes dryer 100*a* according to the present disclosure may secure reliability of a power supply that involves a high voltage. In addition, by the first cathode electrode 122-1*a* and the second cathode electrode 122-2*a* provided as movable grounding electrodes, a circuit may be configured in a simpler way.

An operational process of the clothes dryer 100*a* according to the present disclosure will be described with reference to FIGS. 11 and 12. One object to be dried or a plurality of objects to be dried may be accommodated in each of the first drying space S1*a* and the second drying space S2*a* of the clothes dryer 100*a* according to the present disclosure. Hereinafter, to assist in understanding, a case in which a plurality of objects to be dried (Da: D1*a*, D2*a*, D3*a*, D4*a*, D5*a*, D6*a*) are accommodated in the first drying space S1*a* and the second drying space S2*a* will be described as an example, and the description of the case in which the plurality of objects to be dried are accommodated may be analogically applied to a case in which one object to be dried is accommodated.

FIG. 11 is a view illustrating an example of movements of the first cathode electrode 122-1*a* and the second cathode electrode 122-2*a* when an operational condition of the clothes dryer 100*a* is a drying condition of the objects to be dried Da.

When an operational command of the clothes dryer 100*a* according to the present disclosure is input, the control unit 170 may determine an operational condition of the clothes dryer 100*a* based on information on states of the objects to be dried Da sensed by the sensor unit 140. When the operational condition of the clothes dryer 100*a* satisfies the drying condition of the objects to be dried Da, the first cathode electrode 122-1*a* may move in a first direction, and the second cathode electrode 122-2*a* may move in a second direction. That is, each of the cathode electrodes 122-1*a* and 122-2*a* may move toward the anode electrode 121*a* which is fixed. As a result, as intervals between the electrodes are formed to be narrow and the first drying space S1*a* and the second drying space S2*a* are formed to be narrow, a high-frequency electric field may be efficiently transmitted to the objects to be dried (Da: D1*a*, D2*a*, D3*a*, D4*a*, D5*a*, D6*a*).

Meanwhile, the embodiment is the case in which the plurality of objects to be dried (Da: D1*a*, D2*a*, D3*a*, D4*a*, D5*a*, D6*a*) are accommodated in the clothes dryer 100*a*, and movements of the objects to be dried (Da: D1*a*, D2*a*, D3*a*, D4*a*, D5*a*, D6*a*) may be controlled together with the movements of the electrodes 122-1*a* and 122-2*a* provided at the electrode unit 120*a*. In more detail, each of the objects to be dried D1*a*, D2*a*, and D3*a* accommodated in the first drying space S1*a* may move in the first direction, and each of the objects to be dried D4*a*, D5*a*, and D6*a* accommodated in the second drying space S2*a* may move in the second direction. Although the positions of the objects to be dried (Da: D1*a*, D2*a*, D3*a*, D4*a*, D5*a*, D6*a*) may be controlled simultaneously with the positions of the electrodes 122-1*a* and 122-

2*a*, according to an embodiment, the positions of the objects to be dried (Da: D1*a*, D2*a*, D3*a*, D4*a*, D5*a*, D6*a*) may also be controlled independently.

FIG. 12 is a view illustrating an example of movements of the first cathode electrode 122-1*a* and the second cathode electrode 122-2*a* when an operational condition of the clothes dryer 100*a* is an evaporation condition of the objects to be dried Da.

As a process of drying the objects to be dried Da progresses, the temperature of the objects to be dried Da may continuously rise, and thus controlling for discharging moisture evaporated from the objects to be dried Da may be performed after a predetermined amount of time passes. When an operational condition of the clothes dryer 100*a* satisfies the evaporation condition of the objects to be dried Da, the first cathode electrode 122-1*a* may move in the second direction, and the second cathode electrode 122-2*a* may move in the first direction. That is, each of the cathode electrodes 122-1*a* and 122-2*a* may move in directions of becoming farther from the anode electrode 121*a* which is fixed. As a result, as intervals between the electrodes 122-1*a* and 122-2*a* are formed to be wide and the first drying space S1*a* and the second drying space S2*a* are formed to be wide, the evaporated moisture may be controlled to be easily discharged.

Meanwhile, the embodiment is the case in which the plurality of objects to be dried (Da: D1*a*, D2*a*, D3*a*, D4*a*, D5*a*, D6*a*) are accommodated in the clothes dryer 100*a*, and movements of the objects to be dried (Da: D1*a*, D2*a*, D3*a*, D4*a*, D5*a*, D6*a*) may be controlled together with the movements of the electrodes 122-1*a* and 122-2*a* provided at the electrode unit 120*a*. In more detail, each of the objects to be dried D1*a*, D2*a*, and D3*a* accommodated in the first drying space S1*a* may move in the second direction, and each of the objects to be dried D4*a*, D5*a*, and D6*a* accommodated in the second drying space S2*a* may move in the first direction. In relation to controlling the positions of the objects to be dried (Da: D1*a*, D2*a*, D3*a*, D4*a*, D5*a*, D6*a*), the descriptions overlapping with those mentioned above will be omitted.

Figure 13:
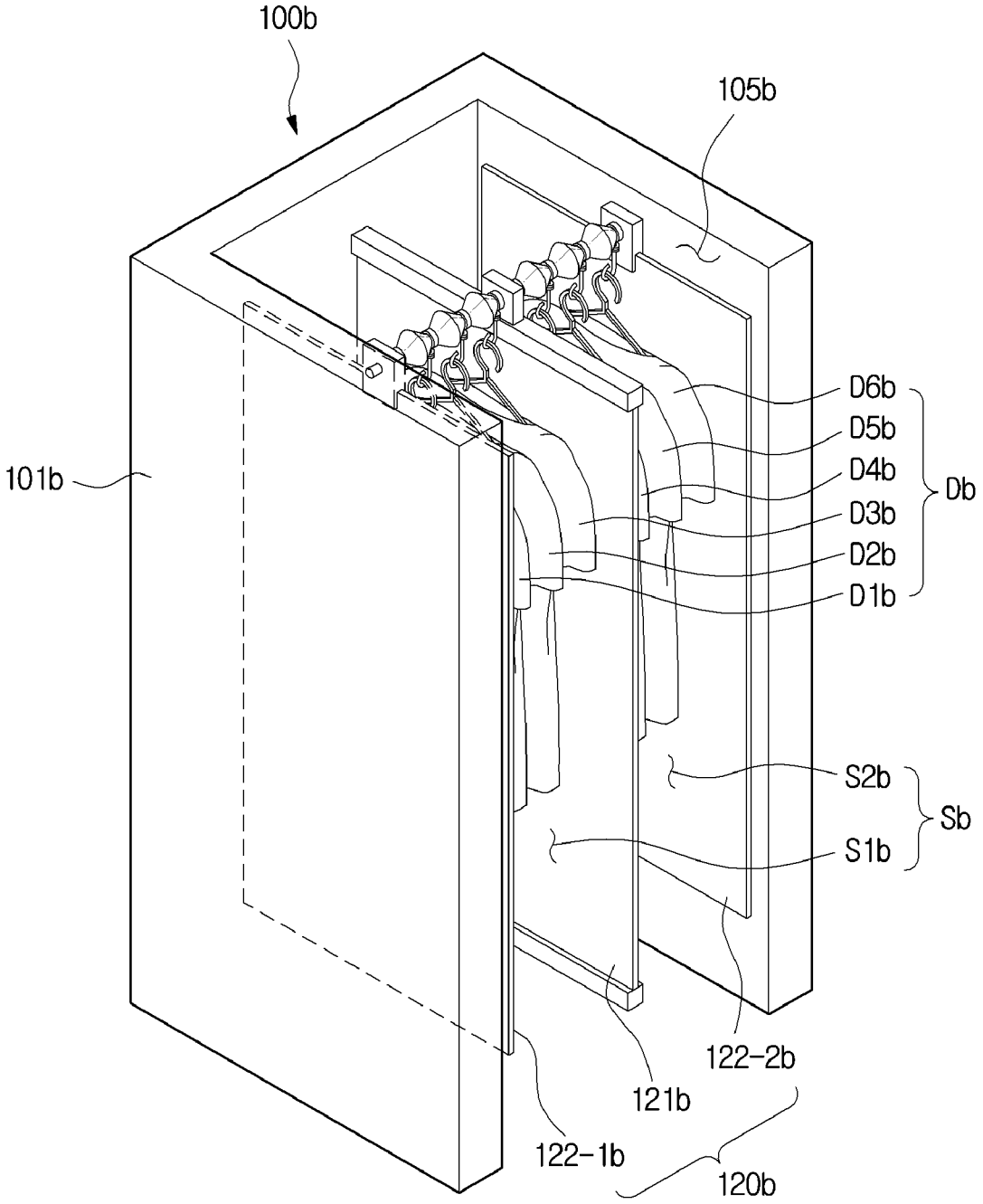
FIG. 13 is a perspective view illustrating a clothes dryer according to still another embodiment.
Figure 14:
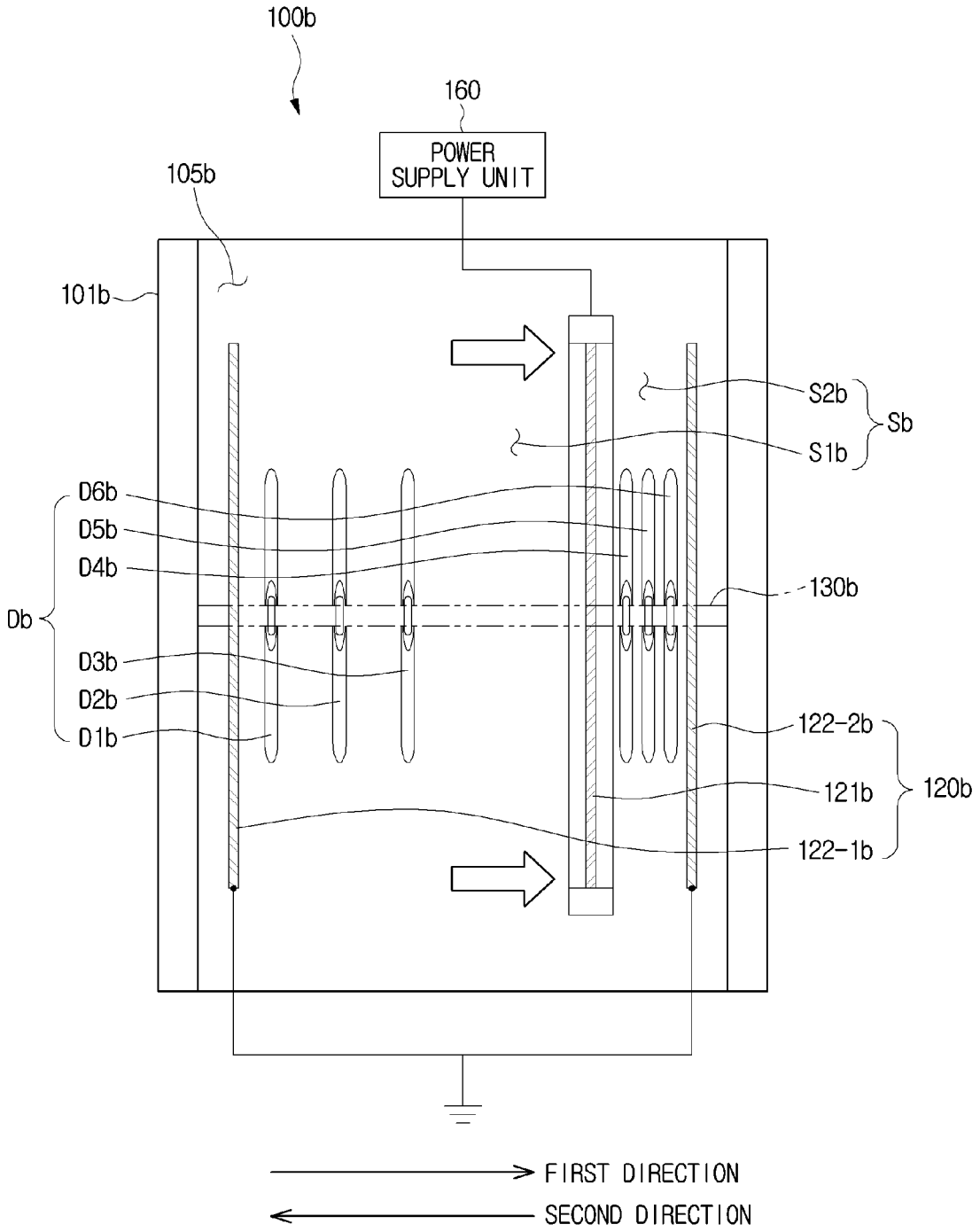
FIGS. 14 and 15 are views illustrating an operational process of the clothes dryer according to FIG. 13.
Figure 15:
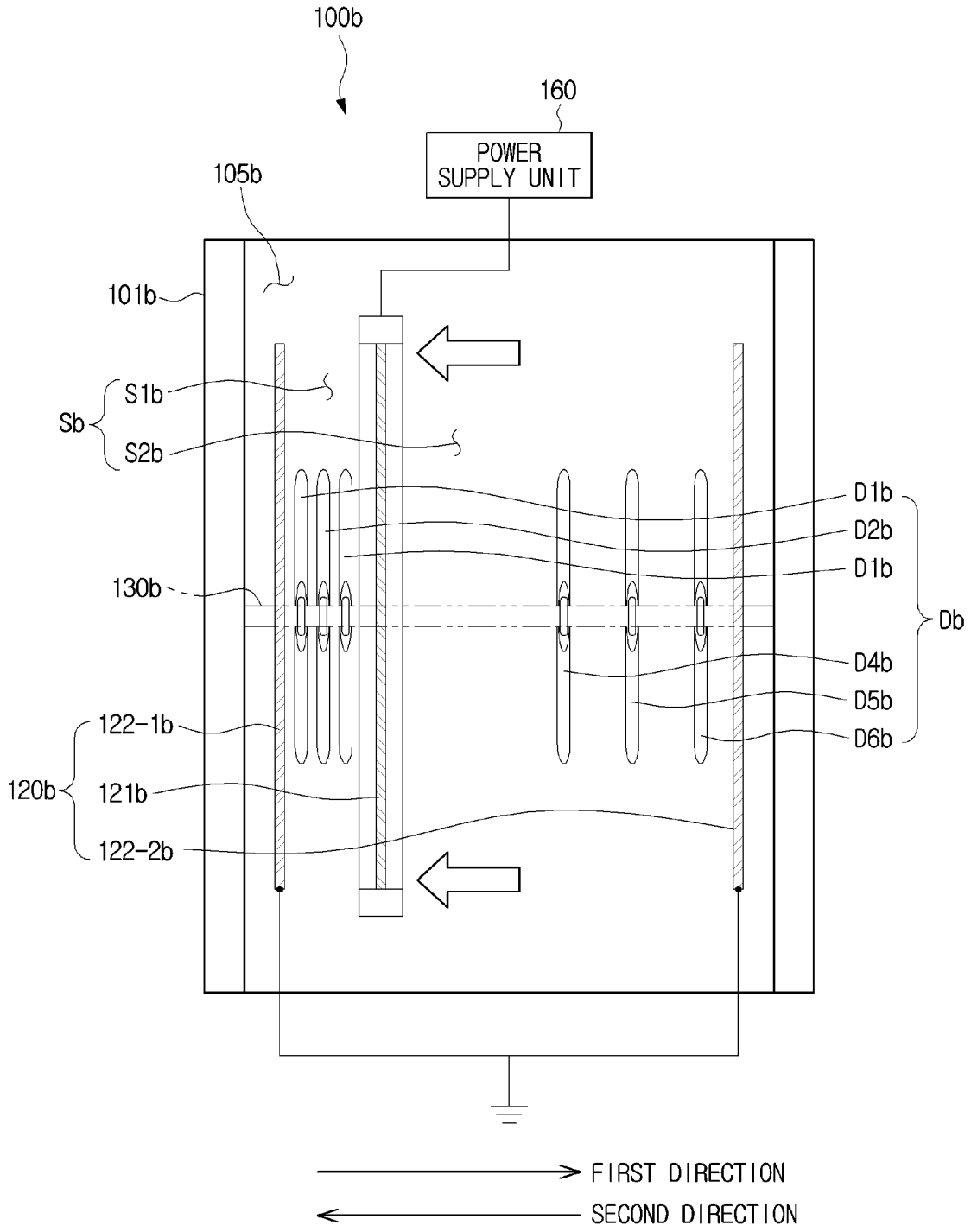

FIG. 13 is a perspective view illustrating a clothes dryer 100*b* according to still another embodiment, and FIGS. 14 and 15 are views illustrating an operational process of the clothes dryer 100*b* according to FIG. 13.

Referring to FIG. 13, in a case of the clothes dryer 100*b* according to the embodiment, configurations such as a main body 101*b*, a drying chamber 105*b*, and a conveying unit 130*b* are similar to those of the clothes dryers 100 and 100*a* illustrated in FIGS. 1 to 4 and FIGS. 10 to 12. However, differences exist in terms of the number and the arrangement forms of electrodes, and hereinafter, differences from the clothes dryers 100 and 100*a* according to FIGS. 1 to 4 and FIGS. 10 to 12 will be mainly described.

An electrode unit 120*b* of the clothes dryer 100*b* according to the embodiment may include an anode electrode 121*b* and cathode electrodes 122-1*b* and 122-2*b* disposed to be spaced apart from the anode electrode 121*b* to form drying spaces (Sb: S1*b*, S2*b*) at in-between portions with the anode electrode 121*b*.

Specifically, the electrode unit 120*b* may include a first cathode electrode 122-1*b*, the anode electrode 121*b* disposed to be spaced apart from the first cathode electrode 122-1*b* to form a first drying space S1*b* at an in-between portion with the first cathode electrode 122-1*b*, and a second cathode electrode 122-2*b* disposed to be spaced apart from the anode electrode 121*b* to form a second drying space S2*b* at an in-between portion with the anode electrode 121*b*. In other words, with respect to one anode electrode 121*b*, the cathode electrodes 122-1*b* and 122-2*b* may be respectively disposed at both sides of the anode electrode 121*b*.

Different from the clothes dryer 100*a* according to FIGS. 10 to 12, in the electrode unit 120*b* of the clothes dryer 100*b* according to the embodiment, the first and second cathode electrodes 122-1*b* and 122-2*b* may be provided to be fixed, and the anode electrode 121*b* may be provided to be movable. By the above arrangement of the electrodes, the clothes dryer 100*b* according to FIG. 13 may divide the drying spaces S1*b* and S2*b* at both sides with respect to the anode electrode 121*b* and may independently control drying processes in each of the drying spaces S1*b* and S2*b*.

An operational process of the clothes dryer 100*b* according to the present disclosure will be described with reference to FIGS. 14 and 15. One object to be dried or a plurality of objects to be dried may be accommodated in each of the first drying space S1*b* and the second drying space S2*b* of the clothes dryer 100*b* according to the present disclosure. Hereinafter, to assist in understanding, a case in which a plurality of objects to be dried (Db: D1*b*, D2*b*, D3*b*, D4*b*, D5*b*, D6*b*) are accommodated in the first drying space S1*b* and the second drying space S2*b* will be described as an example, and the description of the case in which the plurality of objects to be dried (Db: D1*b*, D2*b*, D3*b*, D4*b*, D5*b*, D6*b*) are accommodated may be analogically applied to a case in which one object to be dried is accommodated.

Referring to FIG. 14, as a drying process of the clothes dryer 100*b* progresses, when the anode electrode 121*b* moves in the first direction, an interval between electrodes forming the first drying space S1*b* widens such that intervals between the objects to be dried D1*b*, D2*b*, and D3*b* accommodated in the first drying space S1*b* may be secured to be wide enough, and an interval between electrodes forming the second drying space S2*b* narrows such that high-frequency energy may be effectively transferred to the objects to be dried D4*b*, D5*b*, and D6*b* accommodated in the second drying space S2*b*. Conversely, when the anode electrode 121*b* moves in the second direction as illustrated in FIG. 15, roles of the first drying space S1*b* and the second drying space S2*b* are switched.

In the case of the clothes dryer 100*b* according to the embodiment, optimization of applying high-frequency energy to the objects to be dried (Db: D1*b*, D2*b*, D3*b*, D4*b*, D5*b*, D6*b*) and discharging evaporated moisture may be achieved without an operation of turning high-frequency power applied to the anode electrode 121*b* on or off by dividing the space as mentioned above.

In the above, various examples of arranging electrodes in a clothes dryer according to an embodiment have been described. Although cases in which the anode electrodes 121, 121*a*, and 121*b* and the cathode electrodes 122, 122-1*a*, 122-2*a*, 122-1*b*, and 122-2*b* are each formed in the shape of a flat plate have been described as examples, the shape and the size of each of the electrodes may be modified in various ways.

Various modified examples of shapes of electrodes are illustrated in FIGS. 16 to 20. Although FIGS. 16 to 20 are illustrated based on a case in which cathode electrodes are disposed at both sides of an anode electrode with respect to the anode electrode is, the shapes of electrodes illustrated in FIGS. 16 to 20 may be applied to various arrangement structures of electrodes including the cases of FIGS. 2 and 3.

Figure 16:
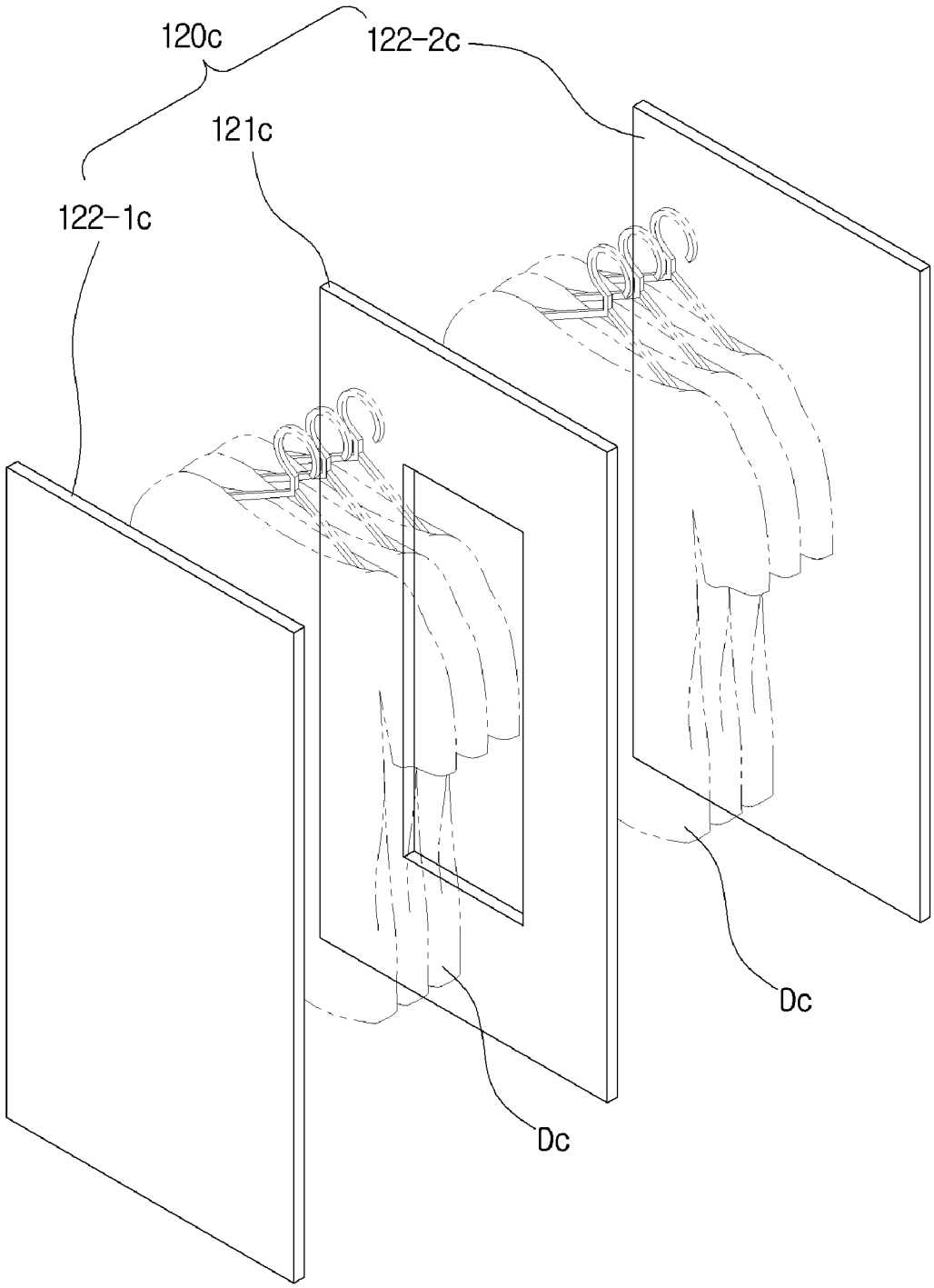
FIGS. 16 to 20 illustrate various modified examples of a shape of an electrode.

Referring to FIG. 16, an anode electrode 121*c* of an electrode unit 120*c* according to an embodiment may be formed in the shape of a rectangular plate with a hole at a central portion thereof, and cathode electrodes 122-1*c* and

122-2*c* formed in the shape of a flat quadrilateral plate may be disposed at both sides of the anode electrode 121*c*. Furthermore, objects to be dried Dc may be disposed between the anode electrode 121*c* and each of the cathode electrodes 122-1*c* and 122-2*c*. Here, the size of the cathode electrodes 122-1*c* and 122-2*c* may be the same as that of the anode electrode 121*c*, and according to an embodiment, may be larger than that of the anode electrode 121*c*.

Figure 17:
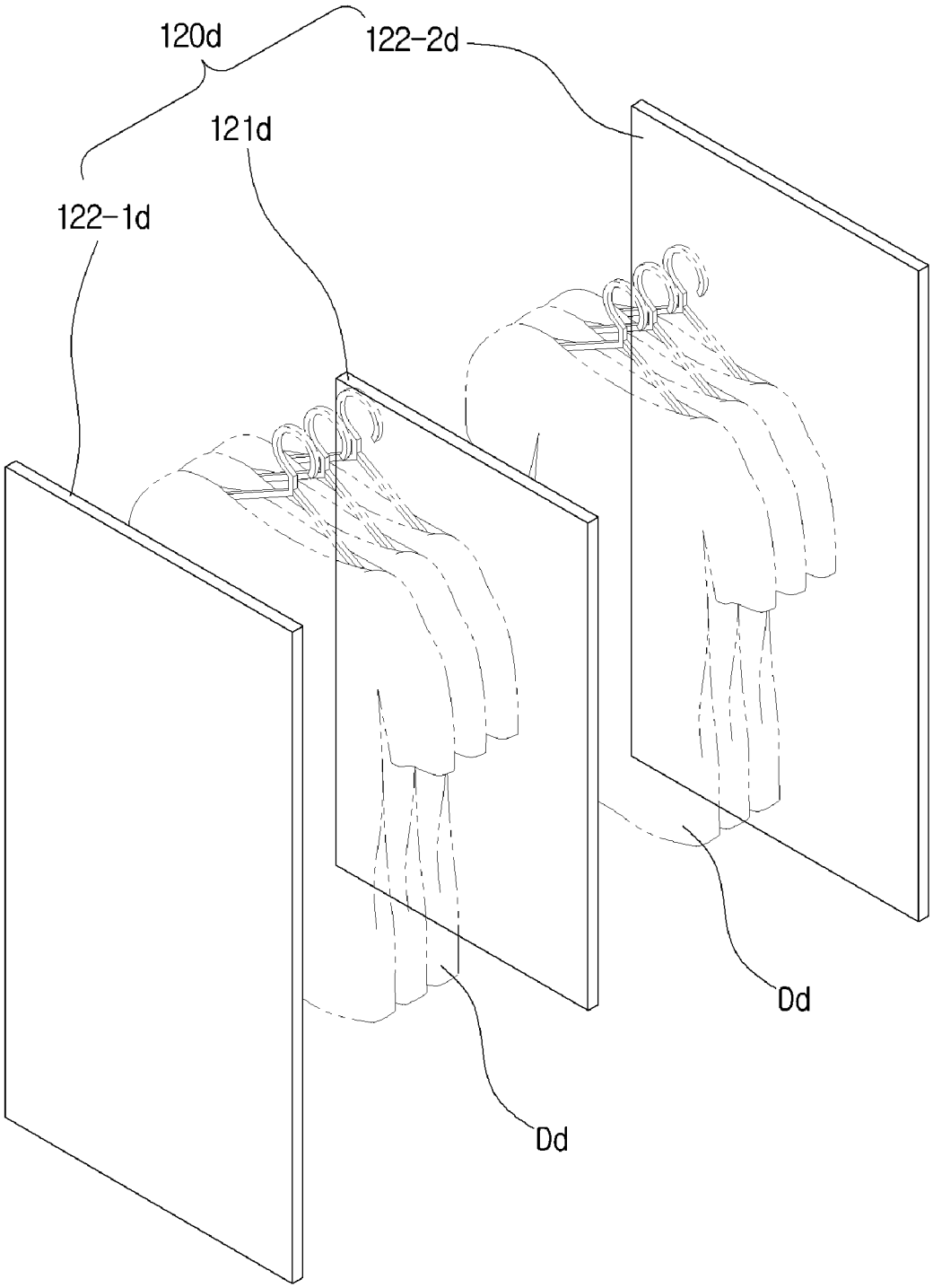

Referring to FIG. 17, an anode electrode 121*d* of an electrode unit 120*d* according to an embodiment may be formed in the shape of a flat quadrilateral plate which is smaller than cathode electrodes 122-1*d* and 122-2*d* facing the anode electrode 121*d*, and the cathode electrodes 122-1*d* and 122-2*d* may be formed in the shape of a flat quadrilateral plate which is larger than the anode electrode 121*d*. According to the electrode unit 120*d* of FIG. 17, a parasitic electric field component generated according to a relative position with a grounding electrode nearby may be minimized and the strength of an electric field in a region where objects to be dried Dd are present may be maximized at the same time.

Figure 18:
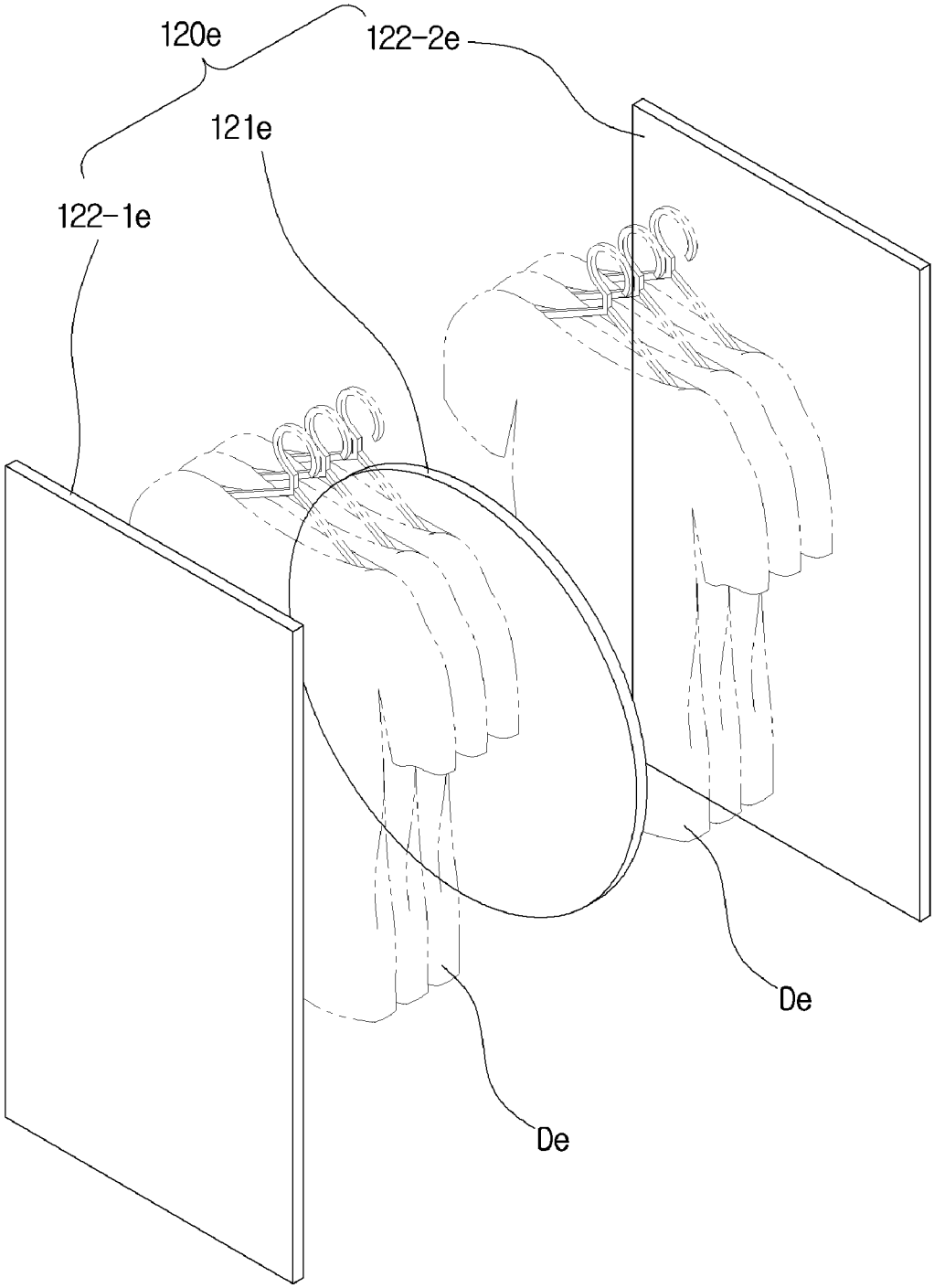

Referring to FIG. 18, an anode electrode 121*e* of an electrode unit 120*e* according to an embodiment may be formed in a circular shape, and cathode electrodes 122-1*e* and 122-2*e* may be formed in the shape of a flat quadrilateral plate. According to an embodiment, the anode electrode 121*e* may be formed in an oval shape. The diameter or the length of the major axis of the anode electrode 121*e* may be the same as or shorter than the area of the cathode electrodes 122-1*e* and 122-2*e*, and in this case, a parasitic electric field component generated according to a relative position with a grounding electrode nearby may be minimized and the strength of an electric field in a region where objects to be dried De are present may be maximized at the same time.

Figure 19:
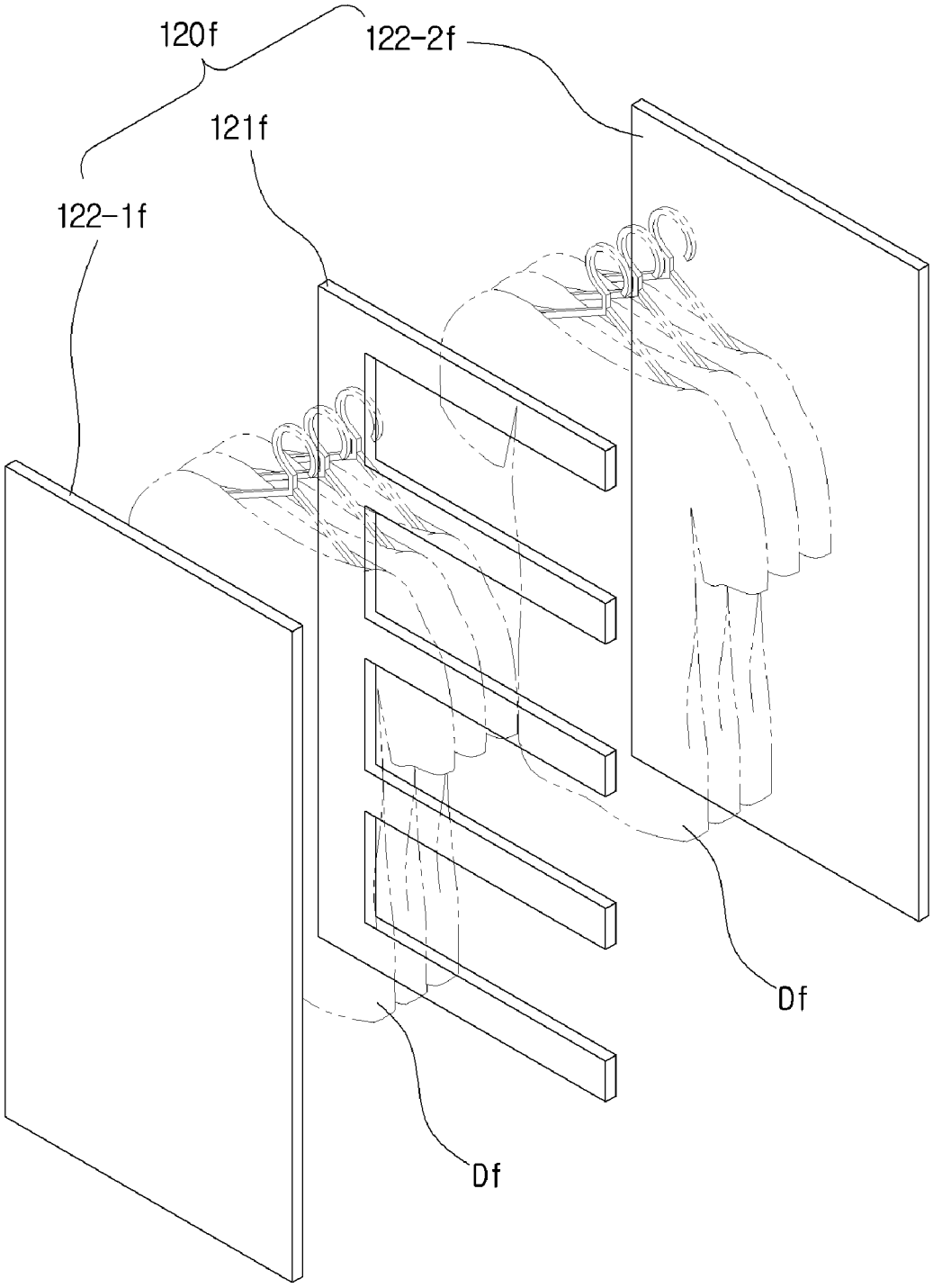

Referring to FIG. 19, an anode electrode 121*f* of an electrode unit 120*f* according to an embodiment may have a structure branched in the shape of a fork, and cathode electrodes 122-1*f* and 122-2*f* may be formed in the shape of a flat quadrilateral plate. In the electrode unit 120*f* according to the embodiment, the branched structure of the anode electrode 121*f* is not limited to that illustrated in FIG. 19, and according to an embodiment, the number and intervals of the branched structure of the anode electrode 121*f* may be changed. When the electrode unit 120*f* is formed in the structure branched in the shape of a fork as illustrated in FIG. 19, high-frequency energy may be transferred to objects to be dried Df and evaporated moisture may be easily discharged to the outside at the same time.

Figure 20:
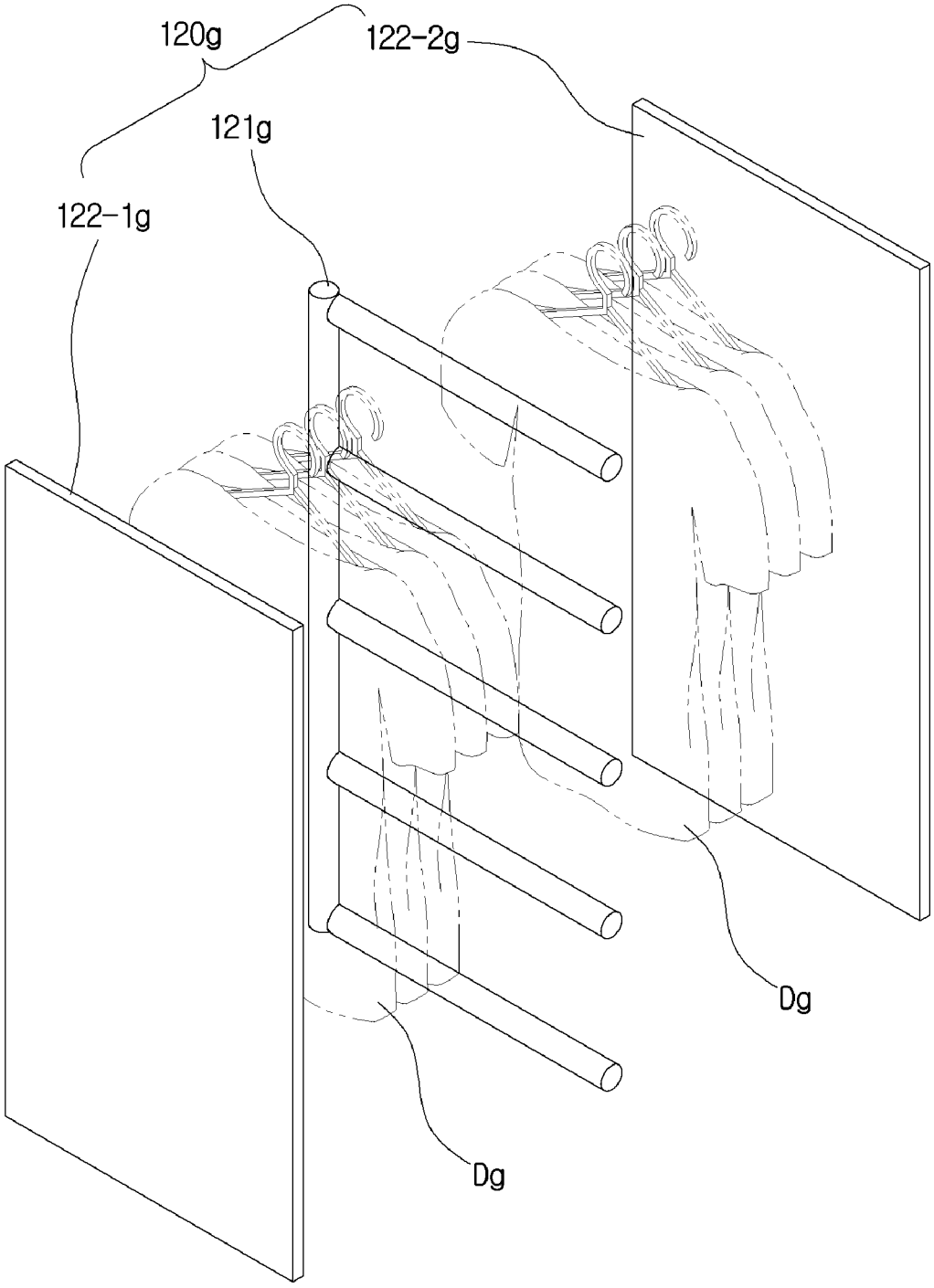

Referring to FIG. 20, an anode electrode 121*g* of an electrode unit 120*g* according to an embodiment may have a structure branched in the shape of a fork, and cathode electrodes 122-1*g* and 122-2*g* may be formed in the shape of a flat quadrilateral plate. Meanwhile, different from the anode electrode 121*f* according to FIG. 19, the anode electrode 121*g* according to FIG. 20 may have a cross-section formed in the shape of a rod. In the electrode unit 120*g* according to the embodiment, the branched structure of the anode electrode 121*g* is not limited to that illustrated in FIG. 20, and according to an embodiment, the number and intervals of the branched structure of the anode electrode 121*g* may be changed.

Meanwhile, the structures of the anode electrode and the cathode electrodes are not limited to those illustrated in FIGS. 16 to 20. Although not illustrated, the shape of an anode electrode may include a convex or concave shape that keeps intervals up to cathode electrodes which are grounding electrodes to be non-uniform.

In addition, according to an embodiment, the shape of cathode electrodes may also be modified in various ways. For example, the cathode electrodes may also be formed in the same shape as the structures of the anode electrodes 121*c*, 121*d*, 121*e*, 121*f*, and 121*g* illustrated in FIGS. 16 to 20 mentioned above. According to an embodiment, when an anode electrode and cathode electrodes are all formed in the shape of a fork, the electrodes may be disposed in a form of facing each other or in a staggered form.

Figure 21:
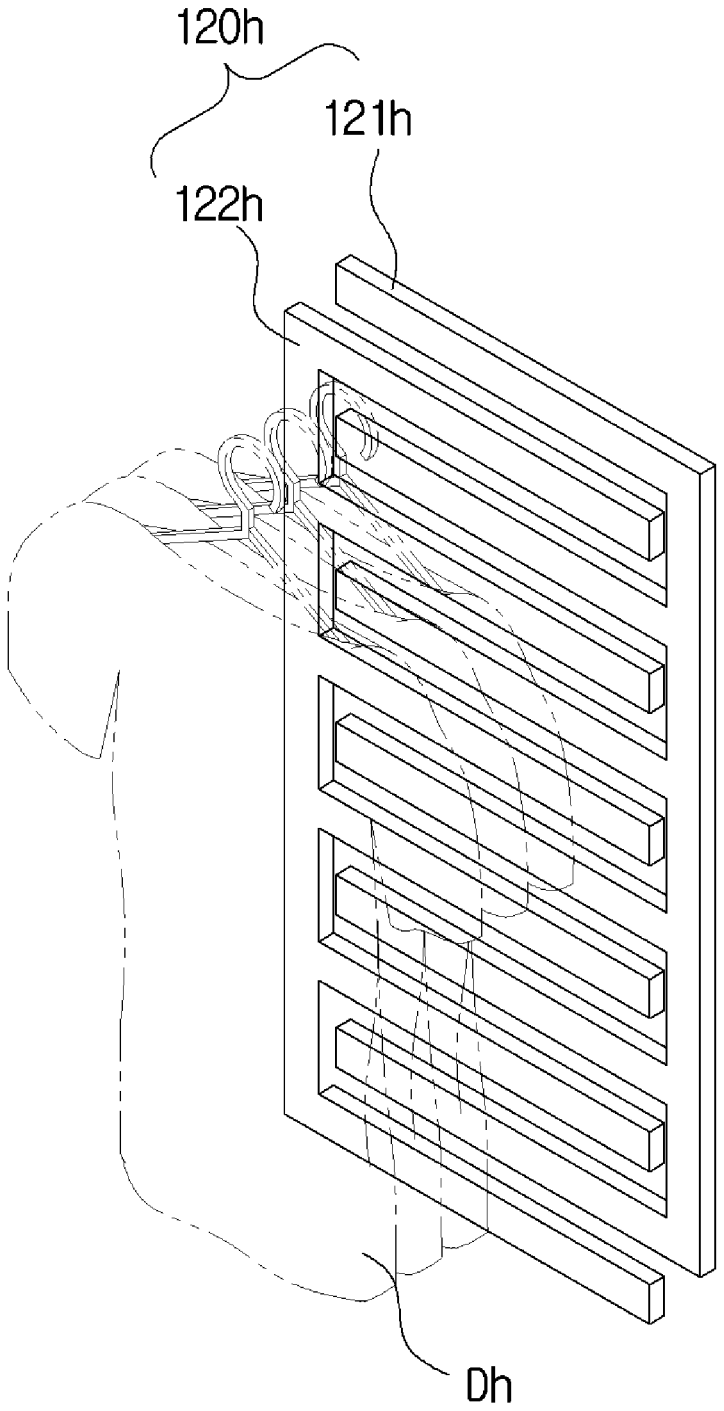
FIG. 21 is a view illustrating still another modified example of a shape of an electrode.

FIG. 21 is a view illustrating still another modified example of a shape of an electrode.

Referring to FIG. 21, an electrode unit 120*h* according to an embodiment may be disposed in a way that an anode electrode 121*h* in the shape of a fork and a cathode electrode 122*h* in the shape of a fork face each other on the same plane. Specifically, the anode electrode 121*h* and the cathode electrode 122*h* may be disposed so that a branched structure of the anode electrode 121*h* and a branched structure of the cathode electrode 122*h* form a zigzag shape, and each of the electrodes 121*h* and 122*h* may be disposed on the same plane. Hereinafter, the arrangement form of the electrode unit 120*h* in the shape mentioned above may be referred to as a zigzag arrangement form.

When the anode electrode 121*h* and the cathode electrode 122*h* are disposed in the zigzag shape, high-frequency energy may be transferred to objects to be dried Dh adjacent to the electrode unit 120*h* due to a fringe-electric-field formed between the anode electrode 121*h* and the cathode electrode 122*h*. Furthermore, in the case of the electrode unit 120*h* according to the embodiment, since the anode electrode 121*h* and the cathode electrode 122*h* are adjacent to each other, formation of a parasitic electric field in a direction of a grounding electrode nearby may be prevented, and as a result, energy loss may be minimized and a more compact configuration of a clothes dryer is possible at the same time.

In the above, various modified examples of an electrode unit have been described.

Hereinafter, examples of forming a high-frequency electric field by the electrode units mentioned above will be described.

Figure 22:
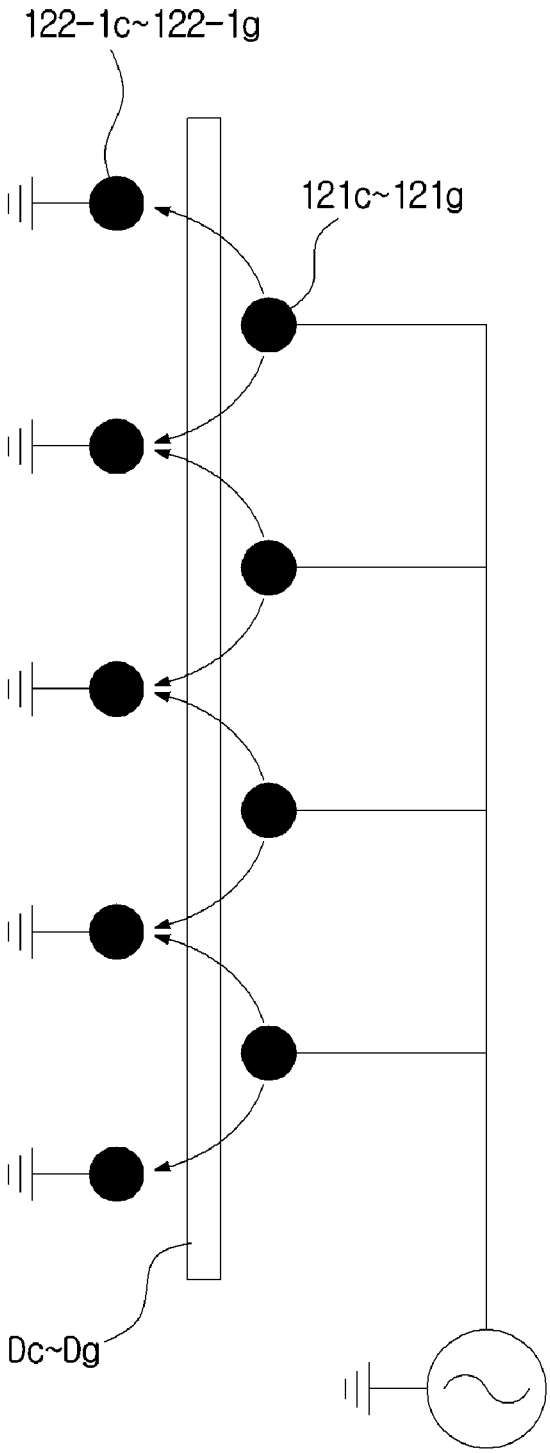
FIGS. 22 to 24 are views illustrating examples of forming a high-frequency electric field.
Figure 23:
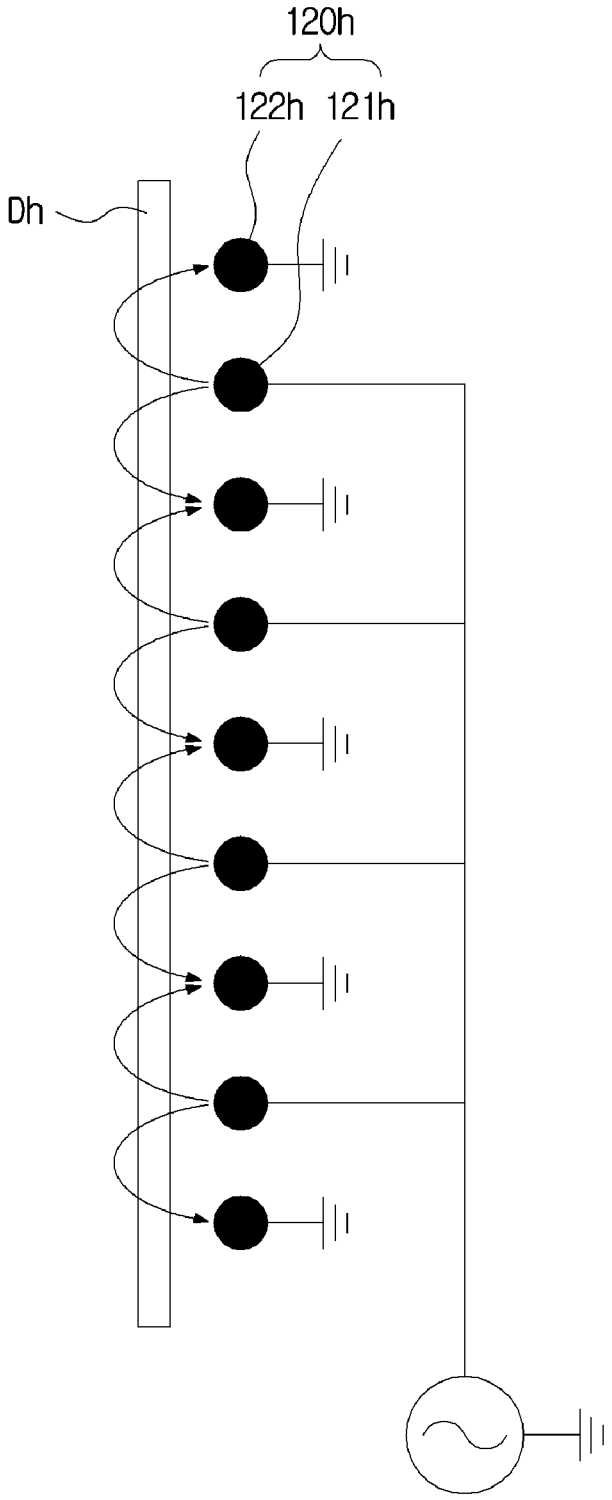
Figure 24:
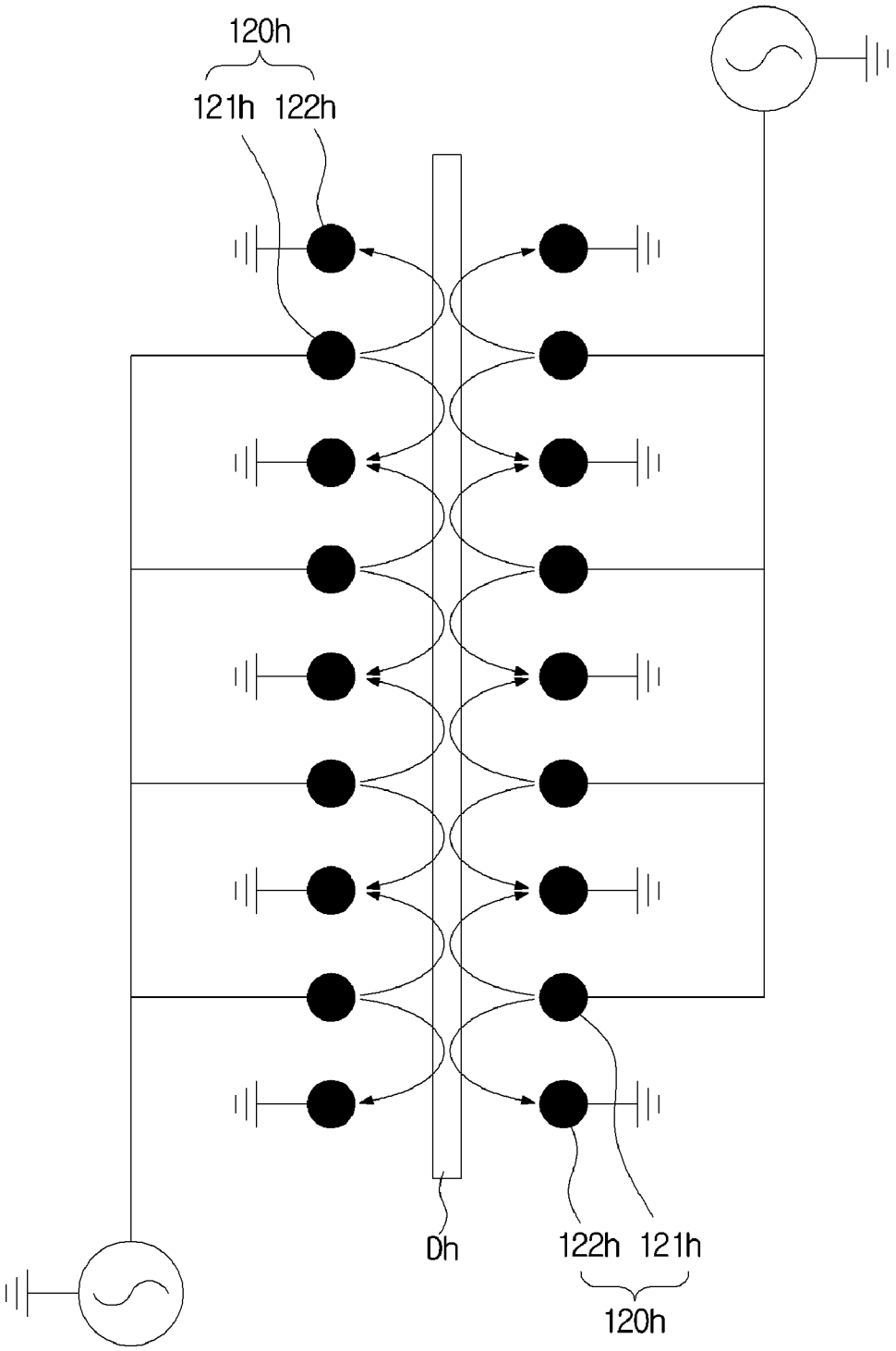

FIGS. 22 to 24 are views illustrating examples of forming a high-frequency electric field. In more detail, FIG. 22 is a view illustrating an example of forming a high-frequency electric field formed by the electrode units 120*c* to 120*g* according to FIGS. 16 to 20, FIG. 23 is a view illustrating an example of forming a high-frequency electric field formed by the electrode unit 120*h* according to FIG. 21, and FIG. 24 is a view illustrating an example of forming a high-frequency electric field when the structure of the electrode unit 120*h* arranged in the zigzag shape according to FIG. 21 is disposed in a plurality.

Referring to FIG. 22, a high-frequency electric field may be formed in a direction from the anode electrodes 121*c* to 121*g* toward the cathode electrodes 122-1*c* to 122-1*g* when high-frequency power is supplied to the anode electrodes 121*c* to 121*g*. In the embodiment, when the objects to be dried Dc to Dg are disposed between the anode electrodes 121*c* to 121*g* and the cathode electrodes 122-1*c* to 122-1*g*, the objects to be dried Dc to Dg may be dried by high-frequency electric fields formed between the anode electrodes 121*c* to 121*g* and the cathode electrodes 122-1*c* to 122-1*g*.

Referring to FIG. 23, a high-frequency electric field may be formed in a direction from the anode electrode 121*h* toward the cathode electrode 122*h* when high-frequency power is supplied to the anode electrode 121*h*. In the embodiment, since the anode electrode 121*h* and the cathode electrode 122*h* are disposed on the same plane, a high-frequency electric field may be formed in a narrower region compared to the case of FIG. 22, and the objects to be dried Dh disposed adjacent to the electrode unit 120*h* may be dried by the high-frequency electric field formed in the electrode unit 120*h*.

However, in the case of the electrode unit 120*h* according to FIG. 23, since a range in which the high-frequency electric field is formed is relatively narrow, a drying performance may be degraded when the thickness of the objects to be dried Dh is thick. Thus, in a case of a clothes dryer according to the embodiment, the structure of the electrode unit 120*h* in which the anode electrode 121*h* and the cathode electrode 122*h* are arranged in the zigzag shape may be disposed in a plurality to secure the drying performance of the clothes dryer.

Referring to FIG. 24, in the clothes dryer according to the embodiment, the structure of the electrode unit 120*h* in which the anode electrode 121*h* and the cathode electrode 122*h* are arranged in the zigzag shape may be disposed in a plurality. The objects to be dried Dh may be dried by high-frequency electric fields formed by each of the structures of the electrode unit 120*h*. In the embodiment, by arranging the structure of the electrode unit 120*h* in which the anode electrode 121*h* and the cathode electrode 122*h* are arranged in the zigzag shape at both sides of the objects to be dried Dh, the efficiency of drying the objects to be dried Dh may be improved.

In the above, various modified embodiments of a clothes dryer having a cabinet form have been described.

Next, as a modified embodiment of the present disclosure, a clothes dryer in the form of a bureau will be described.

Figure 25:
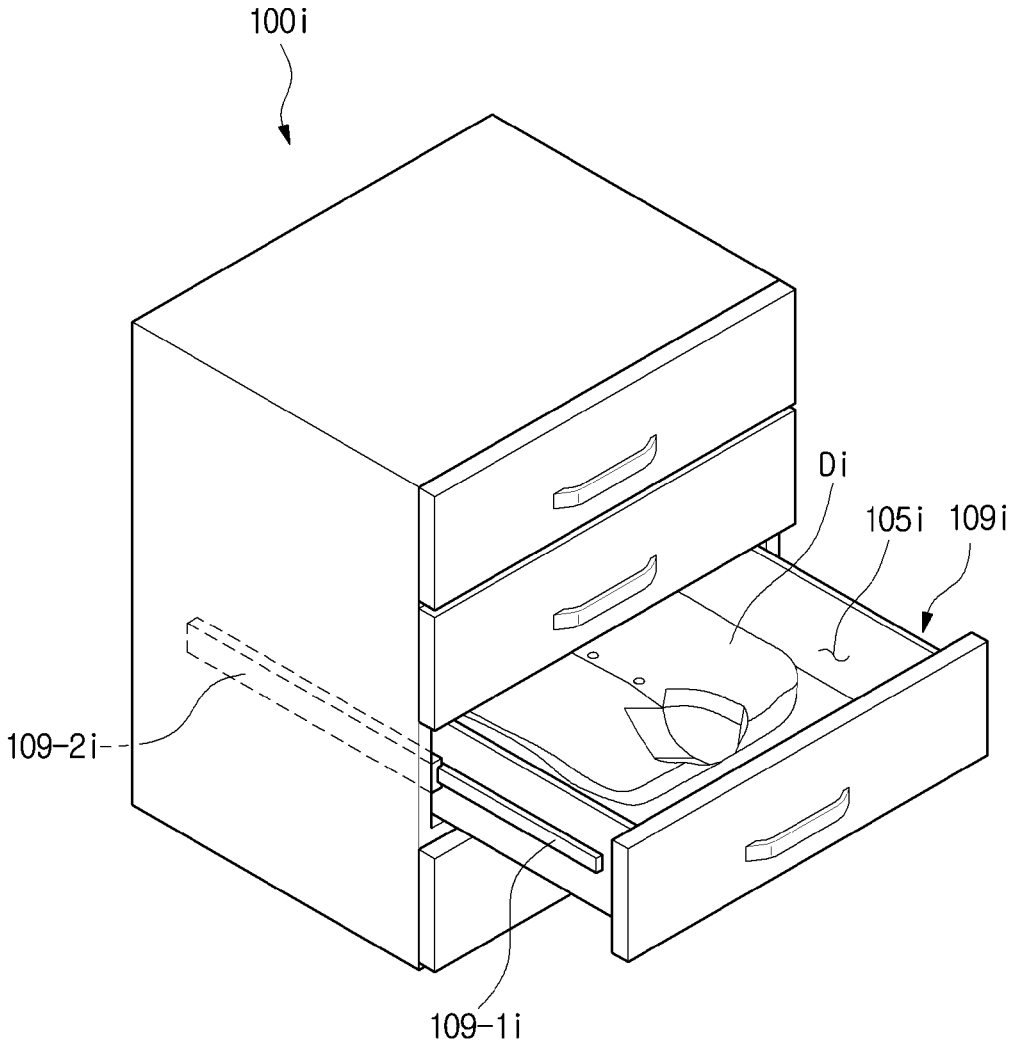
FIG. 25 is a perspective view illustrating an exterior of a clothes dryer in a form of a bureau.
Figure 26:
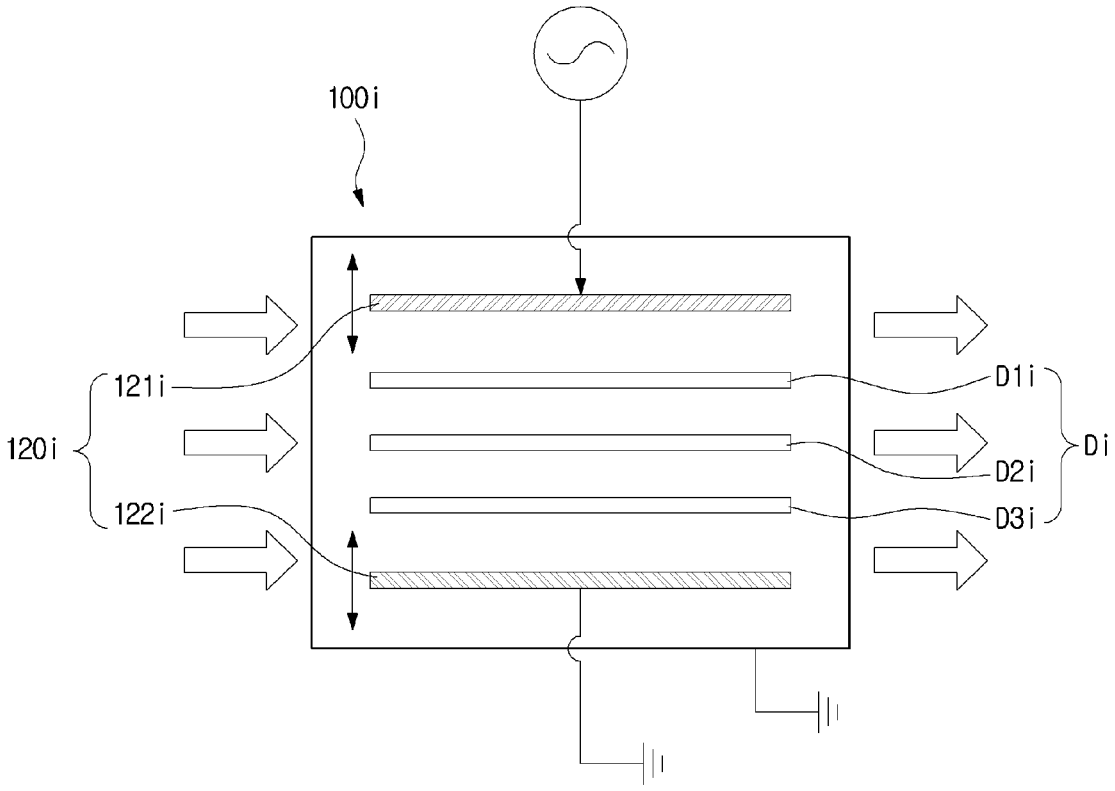
FIG. 26 is a view illustrating a cross-section of the form of the bureau of the clothes dryer according to FIG. 25.

FIG. 25 is a perspective view illustrating an exterior of a clothes dryer 100*i* in the form of a bureau, and FIG. 26 is a view illustrating a cross-section of the form of the bureau of the clothes dryer 100*i* according to FIG. 25. Hereinafter, the clothes dryer 100*i* in the form of the bureau will be described by focusing on differences from the clothes dryer 100 in the form of a cabinet illustrated in FIGS. 1 to 4.

Referring to FIGS. 25 and 26, the clothes dryer 100*i* in the form of a bureau includes a main body 101*i* that forms an exterior and a drying chamber 105*i* installed inside the main body 101*i* and in which drying of objects to be dried Di is performed.

The main body 101*i* may be divided into several sections by a plurality of drawers 109*i*, and each of the drawers 109*i* may be slidably provided. In more detail, fixing rails 109-1*i* may be installed at both side surfaces of the drawers 109*i*, and guide rails 109-2*i* may be installed at both inner side surfaces of the main body 101*i* into which the drawers are inserted in order to guide the fixing rails 109-1*i*.

The drying chamber 105*i* is formed inside the drawers. Although an electrode unit 120*i* of the clothes dryer 100*i* according to the embodiment may be provided similar to the electrode unit 120 of the clothes dryer 100 mentioned above, a direction in which the electrode unit 120*i* is arranged may be different according to an embodiment. For example, when the height of the drawers is smaller than the width of the drawers, electrodes at the electrode unit 120*i* are preferably arranged vertically as illustrated in FIG. 26. In this case, movements of the electrodes provided at the electrode unit 120*i* and objects to be dried (Di: D1*i*, D2*i*, D3*i*) are performed in the vertical direction. In relation to the shape and movement means, etc. of the electrodes in the clothes dryer 100*i* according to the embodiment, the description of the clothes dryer 100 in the form of a cabinet mentioned above may be applied, and hereinafter, descriptions overlapping with those mentioned above will be omitted.

In the above, the clothes dryer having the form of a bureau has been described.

The clothes dryer in the form of a cabinet or the clothes dryer in the form of a bureau mentioned above may each be arranged in combination with other electronic products or pieces of furniture. For example, the clothes dryer may be arranged close to at least one of a washing machine, a wardrobe, and another clothes dryer, and here, the washing machine may include various types of washing machines including a drum-type washing machine and a fully automatic washing machine. Hereinafter, various examples of combining the clothes dryer 100 according to the present disclosure with a washing machine will be described.

FIGS. 27 to 31 are views illustrating various examples of combining the clothes dryer 100 according to the embodiment and a washing machine 200.

The clothes dryer 100 according to the embodiment may be disposed in a direction perpendicular to the washing machine 200 or in a direction parallel to the washing machine 200.

Figure 27:
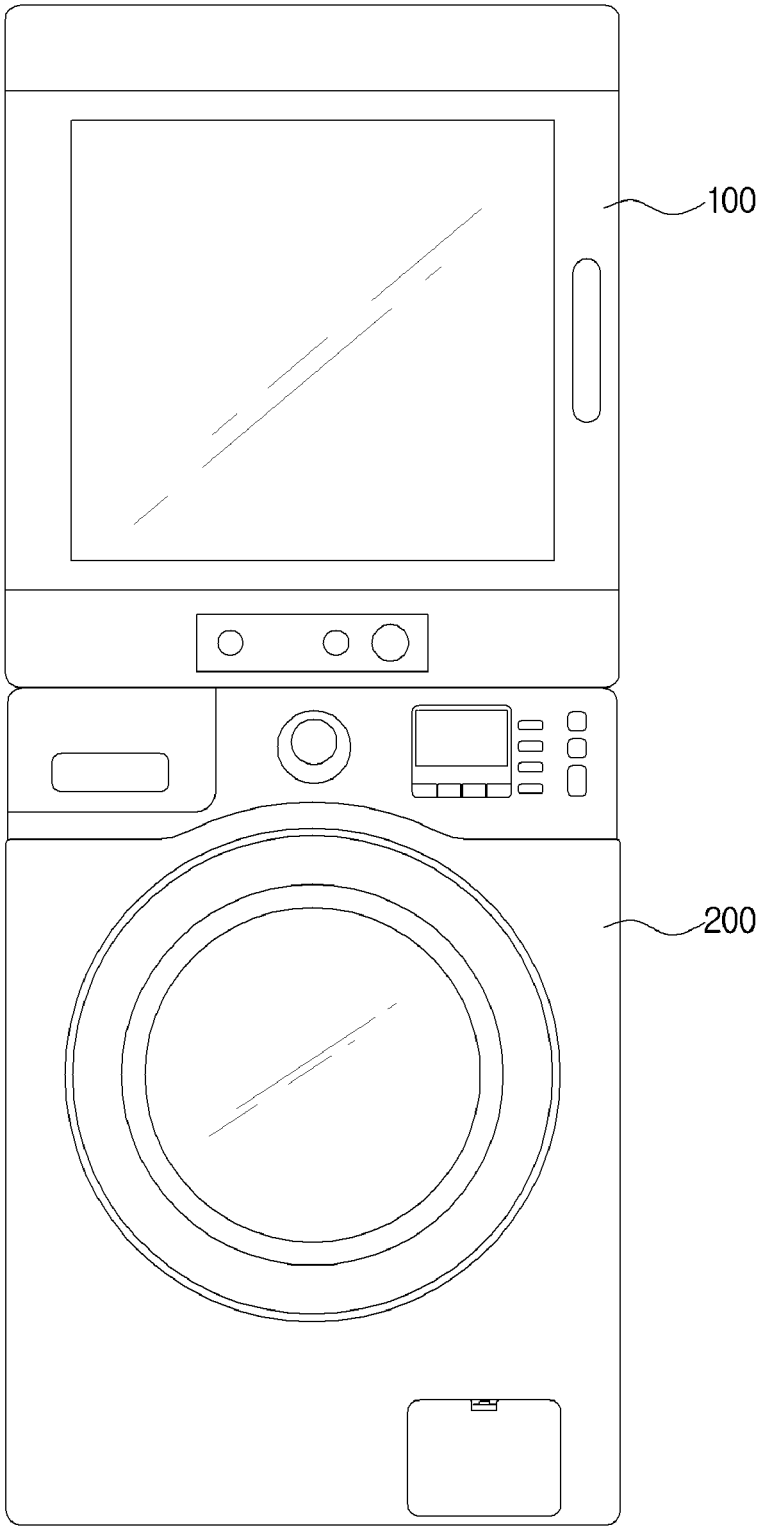
FIGS. 27 to 31 are views illustrating various examples of combining a clothes dryer according to an embodiment and a washing machine.
Figure 28:
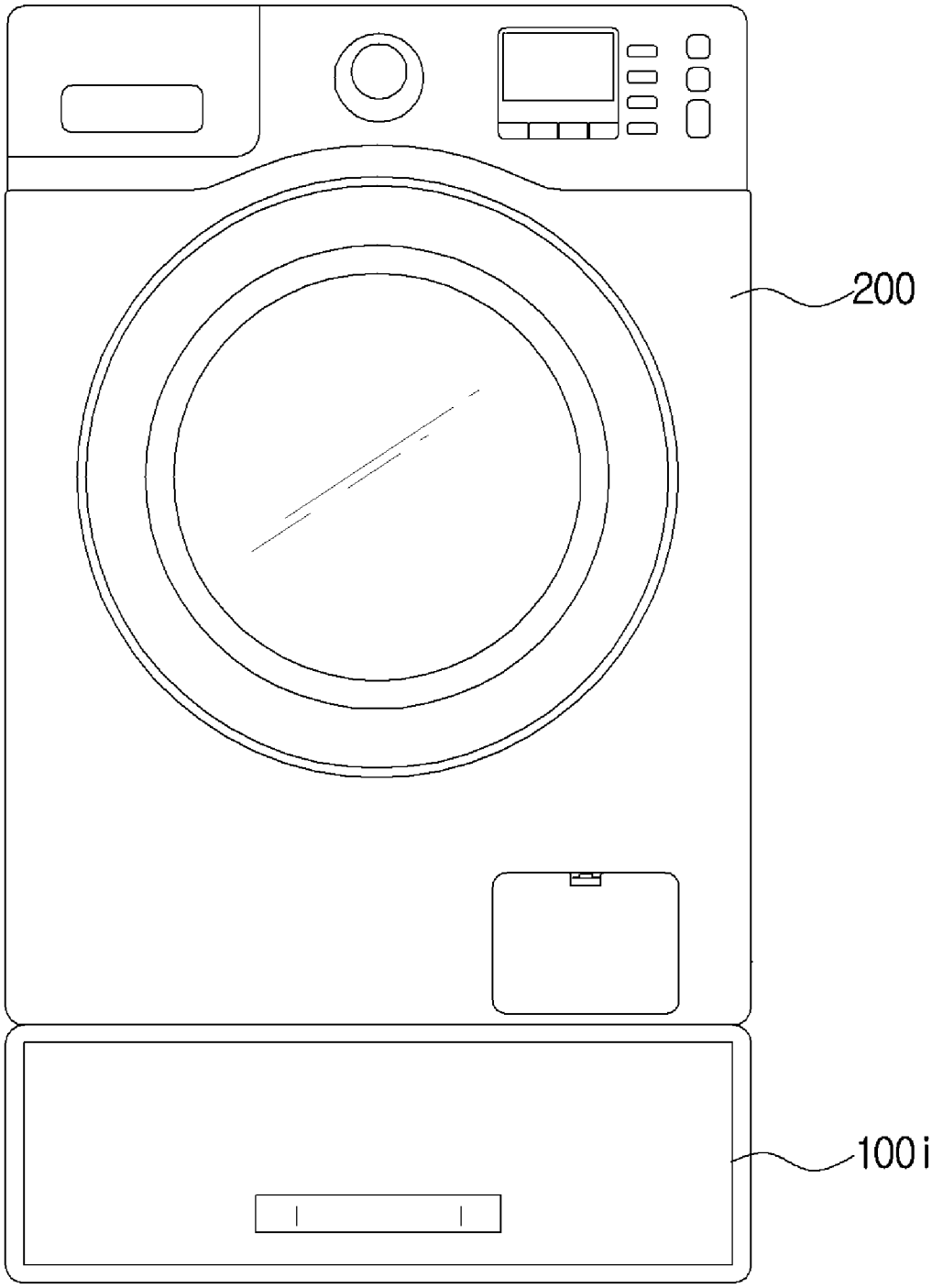
Figure 29:
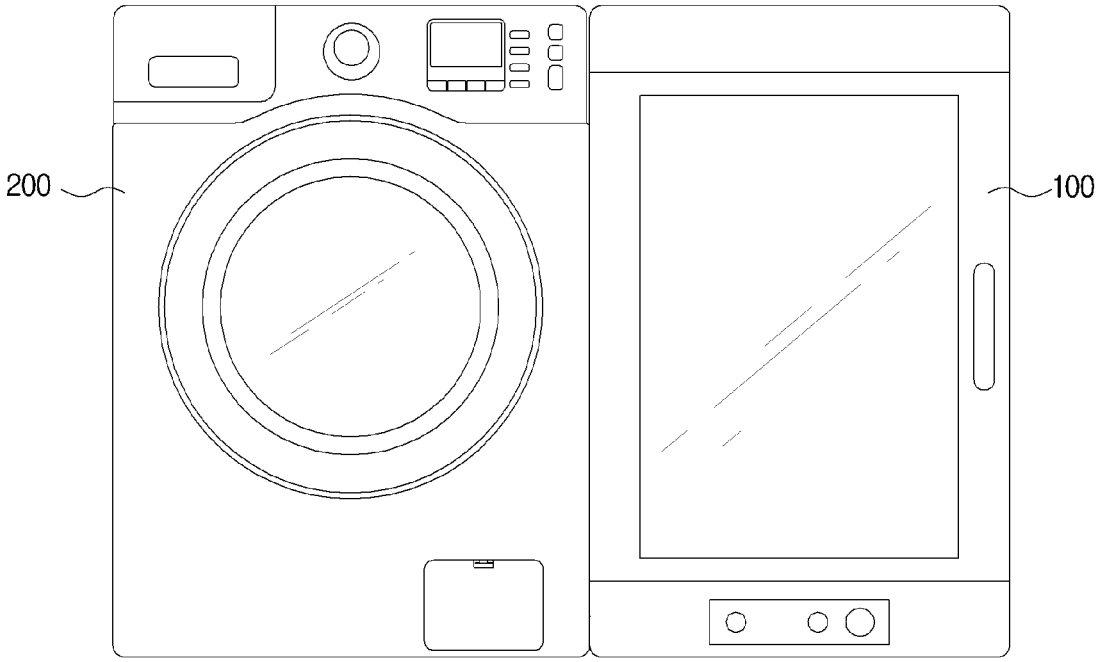
Figure 30:
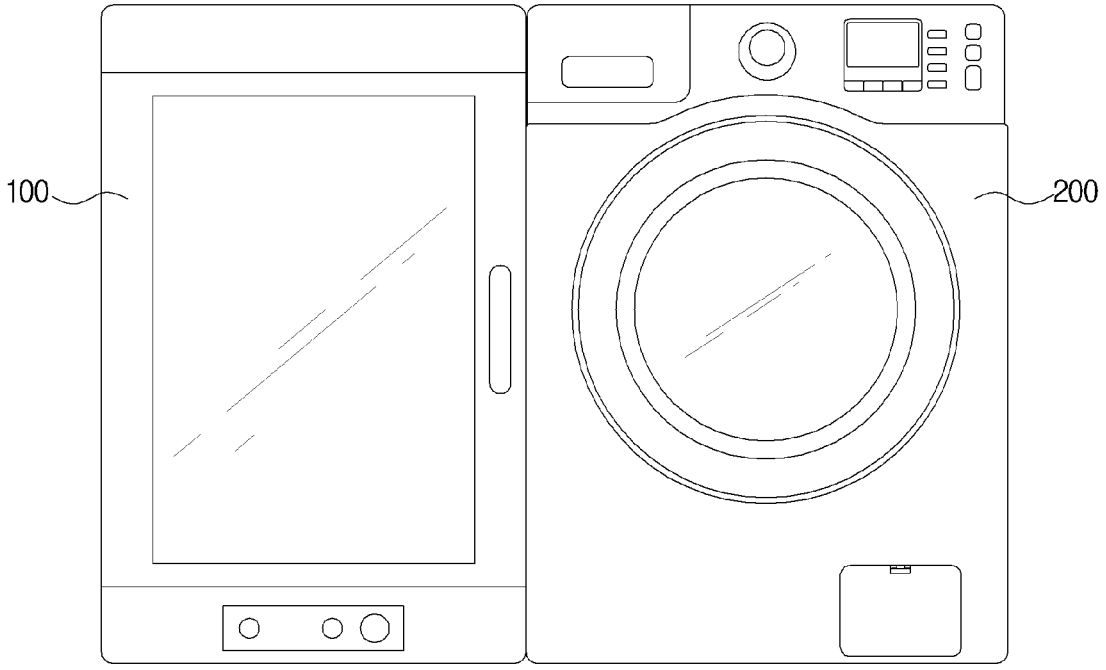

FIG. 27 illustrates an example in which the clothes dryer 100 in the form of a cabinet is disposed at an upper end of the washing machine 200, FIG. 28 illustrates an example in which the clothes dryer 100*i* in the form of a bureau is disposed at a lower end of the washing machine 200, FIG. 29 illustrates an example in which the clothes dryer 100 in the form of a cabinet is disposed at the right of the washing machine 200, and FIG. 30 illustrates an example in which the clothes dryer 100 in the form of a cabinet is disposed at the left of the washing machine 200.

Figure 31:
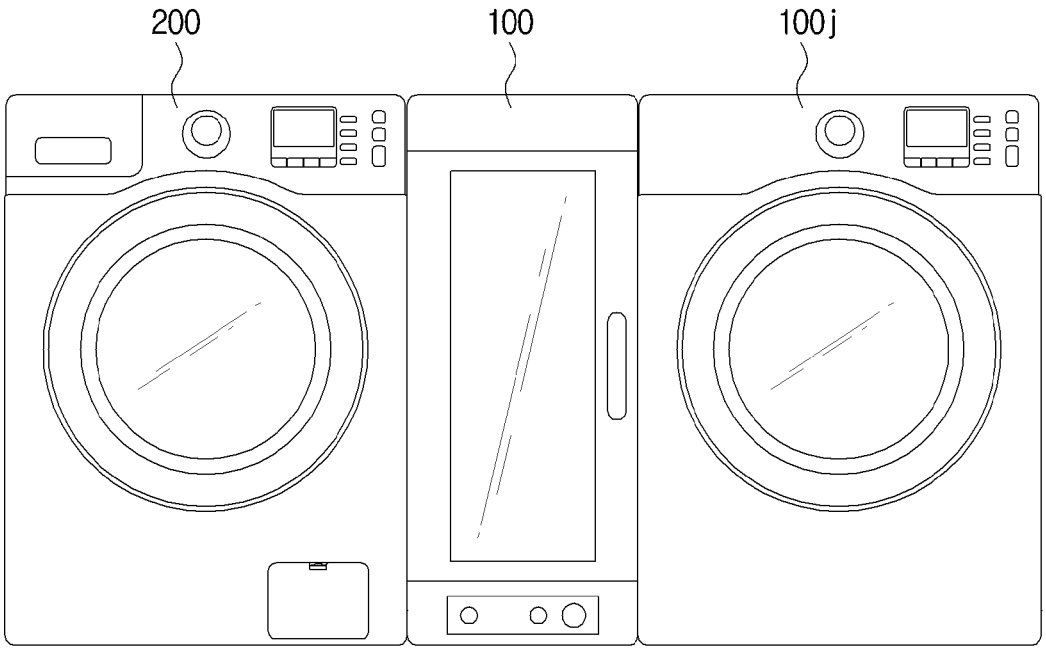

According to an embodiment, the clothes dryer 100 may also be disposed between a washing machine and another clothes dryer. Referring to FIG. 31, the washing machine 200 may be disposed at one side of the clothes dryer 100 in the form of a cabinet and a drum-type clothes dryer 100*j* may be disposed at the other side thereof.

Meanwhile, FIGS. 27 to 31 merely illustrate examples of combining the clothes dryer 100 with the washing machine 200 (or another clothes dryer 100*j*), and examples of arranging the clothes dryer 100 with other apparatuses are not limited to those mentioned above.

In the above, various embodiments of a clothes dryer have been described.

Next, a control method of a clothes dryer will be described.

A control method of a clothes dryer according to an aspect includes sensing information on states of objects to be dried, determining an operational condition of the clothes dryer based on the sensed state information, and controlling movements of the objects to be dried according to the determined operational condition.

A control method of a clothes dryer according to another aspect includes sensing information on states of objects to be dried, determining an operational condition of the clothes dryer based on the sensed state information, and controlling movements of electrodes provided at an electrode unit according to the determined operational condition.

A control method of a clothes dryer according to still another aspect includes sensing information on states of objects to be dried, determining an operational condition of the clothes dryer based on the sensed state information, and controlling movements of the objects to be dried and electrodes provided at an electrode unit according to the determined operational condition.

That is, in the case of the clothes dryer according to the present disclosure, only movements of objects to be dried may be controlled or only a movement of an electrode may be controlled, and according to an embodiment, the movements of the objects to be dried and the electrode may simultaneously be controlled. Hereinafter, a case in which movements of objects to be dried and an electrode are simultaneously controlled will be described as an example based on a case in which a plurality of objects to be dried are accommodated in a drying space in order to describe a control method of a clothes dryer (refer to the clothes dryer 100 according to FIG. 3). Hereinafter, description of the case in which objects to be dried and an electrode unit are simultaneously controlled may include descriptions of the case in which only the movements of the objects to be dried are controlled and the case in which only the movement of an electrode is controlled.

Figure 32:
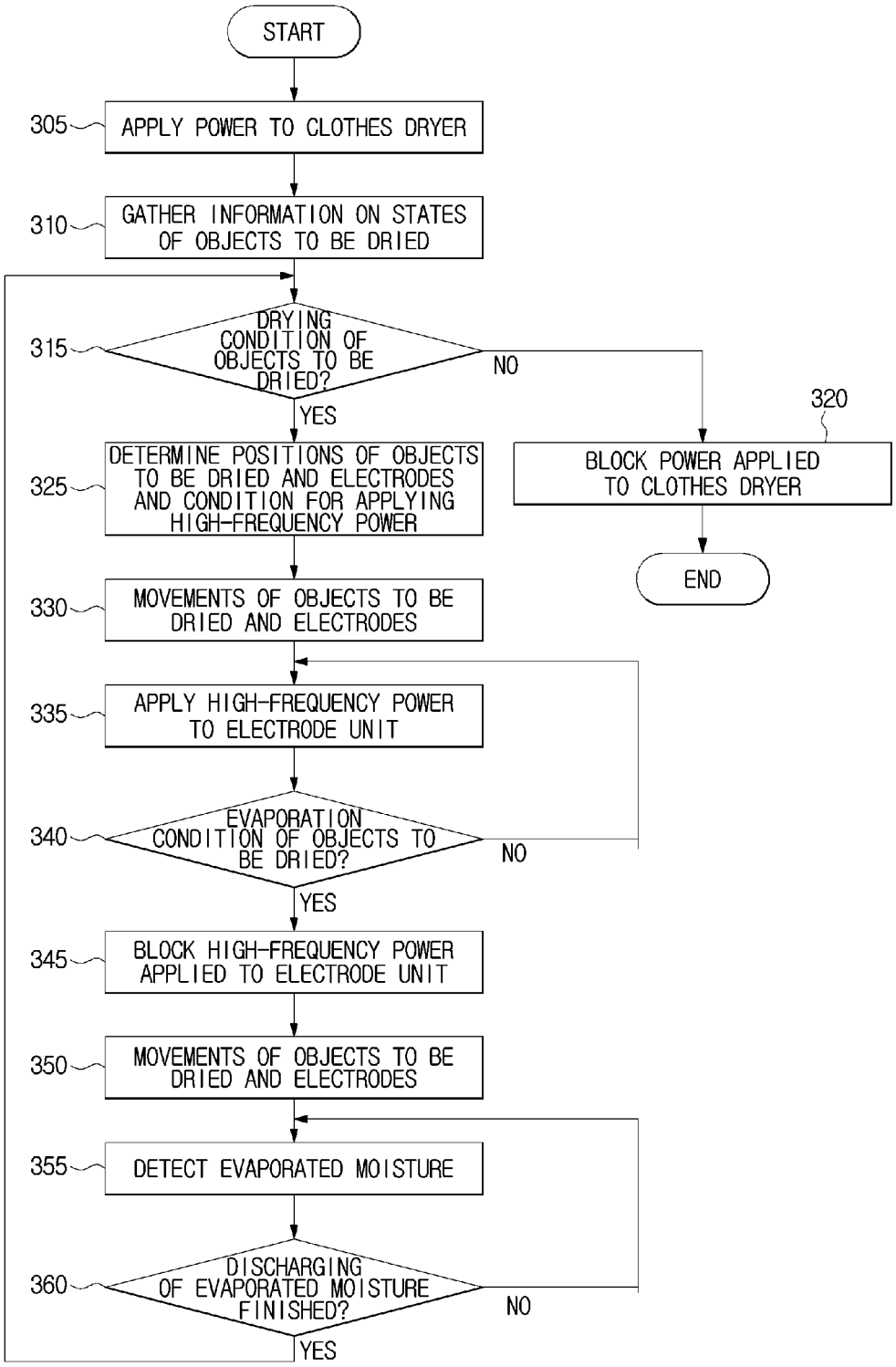
FIG. 32 is a flowchart illustrating a process of controlling a clothes dryer according to an embodiment.

FIG. 32 is a flowchart illustrating a process of controlling the clothes dryer 100 according to an embodiment.

Referring to FIG. 32, when power is applied to the clothes dryer 100, the control unit 170 determines an operational condition of the clothes dryer 100, and more specifically, determines whether the operational condition is the drying condition of the objects to be dried D.

In more detail, when power is applied to the clothes dryer 100, the sensor unit 140 may receive a control signal to sense information on a state of the objects to be dried D from the control unit 170. The sensor unit 140 may sense information on a state of the objects to be dried D according to a command of the control unit 170 and may output the sensed information to the control unit 170. Here, the information on a state of the objects to be dried D may include impedance information, humidity level information, weight information, etc. on the objects to be dried D (S305, S310).

The control unit 170 determines whether the operational condition is the drying condition of the objects to be dried D based on the information on a state of the objects to be dried D sensed by the sensor unit 140 (S315).

When the operational condition is not the drying condition of the objects to be dried D, the control unit 170 may determine drying of the objects to be dried D as unnecessary and block power applied to the clothes dryer 100 (S320).

When the operational condition is the drying condition of the objects to be dried D, the control unit 170 may determine drying of the objects to be dried D as necessary, determine positions of the objects to be dried D and the electrodes provided at the electrode unit 120, and determine a condition for applying high-frequency power to the electrode unit 120 (S325).

Then, the objects to be dried D and the electrodes may move to positions determined by the control unit 170. The objects to be dried D and the electrodes may move in predetermined intervals, and according to an embodiment, may also simultaneously move (S330).

When the objects to be dried D and the electrodes have moved to the positions determined by the control unit 170, high-frequency power may be applied to the electrode unit 120. In more detail, the high-frequency power may be applied via the anode electrode 121 of the electrode unit 120, and thus, a process of drying the objects to be dried D may be performed (S335).

As the process of drying the objects to be dried D progresses, a temperature of the objects to be dried D may continuously rise and evaporated moisture may be discharged from the objects to be dried D at the same time. Thus, in the case of the clothes dryer 100 according to the present disclosure, an evaporation process of the objects to be dried D may be cyclically performed when the evaporation condition of the objects to be dried D is satisfied in order to allow the objects to be dried D to be efficiently dried.

The control unit 170 may determine whether the operational condition is the evaporation condition of the objects to be dried D based on the information on a state of the objects to be dried D sensed by the sensor unit 140 (S340).

When the operational condition is not the evaporation condition of the objects to be dried D, high-frequency power may be continuously applied to the electrode unit 120 (S335).

When the operational condition is the evaporation condition of the objects to be dried D, the high-frequency power applied to the electrode unit 120 may be blocked and then the objects to be dried D and the electrodes provided at the electrode unit 120 may move. Although the objects to be dried D and the electrodes may move to initial states, examples of positions to which the objects to be dried D and the electrodes are movable are not limited thereto. In other words, the objects to be dried D and the electrodes may move to positions considered to facilitate discharge of evaporated moisture according to the determination by the control unit 170 (S345, S350).

Then, the sensor unit 140 may receive a control signal to detect evaporated moisture from the control unit 170. The sensor unit 140 may sense information on evaporated moisture evaporated from the objects to be dried D according to a command of the control unit 170 and transmit the sensed information to the control unit 170 (S355).

The control unit 170 may determine whether discharging of the evaporated moisture is finished based on the information on the evaporated moisture sensed by the sensor unit 140 (S360).

When the discharging of the evaporated moisture is not finished, the sensor unit 140 may continuously sense information on the evaporated moisture and transmit the sensed information to the control unit 170 (S355).

When the discharging of the evaporated moisture is finished, the process mentioned above may be repeated by returning to the step S315.

In the above, although embodiments of the present disclosure have been described, the present disclosure is not limited to the particular embodiments described above and may be modified and executed in various ways without departing from the scope claimed by the claims below by those of ordinary skill in the art to which the present disclosure pertains.

What is claimed is:

1. A control method of a dryer, the control method comprising:

sensing information on states of objects to be dried;

determining an operational condition of the dryer based on the sensed state information; and controlling movements of the objects to be dried by a conveyor according to the determined operational condition, the controlling movements of the objects to be dried including adjusting intervals between the objects to be dried accommodated in the dryer.

2. The control method of claim 1, wherein the sensing information on states of the objects to be dried includes sensing at least one of state information among impedance information, temperature information, humidity level information, weight information, position information, and number information on the objects to be dried.

3. The control method of claim 1, wherein the determining the operational condition of the dryer includes determining at least one of a drying condition and an evaporation condition of the objects to be dried.

4. The control method of claim 3, wherein the controlling movements of the objects to be dried includes:

when actual resistance of impedance of the objects to be dried is a preset first resistance or higher, determining the operational condition as the drying condition of the objects to be dried and controlling intervals between the objects to be dried to be a preset first interval;

when a temperature of the objects to be dried is a preset first temperature or higher, determining the operational condition as the evaporation condition of the objects to be dried and controlling the intervals between the objects to be dried to be a preset second interval which is wider than the first interval.

5. The control method of claim 4, wherein the determining the operational condition of the dryer further includes:

determining the drying condition as a gently drying condition when actual resistance of impedance of the objects to be dried is the first resistance or higher and less than a preset second resistance; and determining the drying condition as an intensively drying condition when actual resistance of impedance of the objects to be dried is the second resistance or higher.

6. The control method of claim 5, wherein the controlling of the movements of the objects to be dried includes:

controlling the intervals between the objects to be dried to be the first interval when the operational condition of the dryer is determined as the gently drying condition; and controlling the intervals between the objects to be dried to be a preset third interval which is narrower than the first interval when the operational condition of the dryer is determined as the intensively drying condition.

7. The control method of claim 1, wherein the dryer includes an electrode unit that forms a high-frequency electric field in a drying space; and the control method further includes supplying high-frequency power to the electrode unit according to the determined operational condition.

* * * * *